United States Patent [19]

Sisson

[11] 4,107,364

[45] Aug. 15, 1978

[54] RANDOM LAID BONDED CONTINUOUS FILAMENT CLOTH

[75] Inventor: James Bryant Sisson, Hamilton, Ohio

[73] Assignee: The Procter & Gamble Company, Cincinnati, Ohio

[21] Appl. No.: 584,312

[22] Filed: Jun. 6, 1975

[51] Int. Cl.[2] ..... B32B 3/00

[52] U.S. Cl. ..... 428/196; 428/152; 428/198; 428/236; 428/246; 428/296; 428/297; 428/302; 428/425

[58] Field of Search ..... 264/171, 174, DIG. 75; 428/236, 238, 247, 296, 298, 302, 360, 171, 172, 195, 196, 197, 198, 425; 156/178, 176, 167, 62.4, 209, 290, 306

[56] References Cited

U.S. PATENT DOCUMENTS

| | | | |
|---|---|---|---|
| 3,338,992 | 8/1967 | Kinney | 264/24 |
| 3,353,345 | 11/1967 | Setzer | 264/DIG. 75 |
| 3,436,797 | 4/1969 | Graf et al. | 156/167 |
| 3,439,085 | 4/1969 | Hartmann | 156/167 |
| 3,554,854 | 1/1971 | Hartmann | 428/224 |
| 3,676,239 | 7/1972 | Soehngen | 156/209 |
| 3,692,618 | 9/1972 | Dorschner et al. | 156/167 |
| 3,912,567 | 10/1975 | Schwartz | 156/290 |

*Primary Examiner*—James J. Bell

*Attorney, Agent, or Firm*—John V. Gorman; Richard C. Witte; Thomas H. O'Flaherty

[57] ABSTRACT

This application discloses a cloth structure comprising preferably generally continuous melt spun organic polymer filaments dispersed and laid to provide frequent random filament crossings, subsequently bonded to form a coherent cloth. In accordance with one aspect of the disclosed invention, a stream of filaments is melt spun through a linear spinnerette having a plurality of spinnerette orifices or rows of orifices offset to enable interleaving of the extruded filaments into a planar single row stream of filaments which are mechanically drawn to textile denier while still arranged in such single row stream on a draw roll having its surface in alignment with the axis of the spinnerette and then forwarded in such single row stream to a formation location closely coupled with a porous collection surface whereat the filaments are dispersed randomly or in directed formation onto the porous collection surface. In accordance with this aspect of the invention the controlled spinning, drawing and forwarding and the close coupling provide a precisely defined focus or divergence point for laydown of each filament in the stream and a limited and controlled excursion of each filament symmetrically about its focus. In accordance with another aspect of the disclosed invention at least some of the dispersed filaments are random laid to form an unbonded web on a porous woven fabric having generally uniform knuckle heights and the unbonded web comprised thereof is carried while still on the fabric and together therewith through a heated bonding nip to emboss the fabric knuckles into the web, providing spaced apart spot bond points and a textured surface to the bonded cloth produced thereby. In accordance with yet another aspect of the disclosed invention, there are provided at least two types of preferably generally continuous filaments, at least one of which is relatively elastomeric, at least one of which is generally uniformly dispersed and random laid to provide frequent random filament crossings, at least some of which are bonded, preferably autogenously, to form a coherent bonded cloth. In accordance with this aspect of the invention the fibers are selected to have differing stretch characteristics such that, under a given common percent elongation, inelastic or permanent deformation will be produced in at least one fiber type in the cloth and elastic or non-permanent deformation will be produced in at least one other type of fiber in the cloth. In accordance with yet still another aspect of this invention, such a coherent bonded cloth containing at least one relatively elastomeric filament type and one elongatable but relatively non-elastic filament type is then mechanically worked after bonding, as by stretching, beyond the elastic limit of the non-elastic filaments followed by relaxation of the relatively elastomeric filaments to develop the cloth to a low modulus of elasticity in the direction or directions of stretch. Yet still another aspect of the disclosed invention is the production of bonded cloth by control of the extent of orientation and extent of drawdown of melt spun filaments. Other aspects of the disclosed invention are methods and apparatus for producing the bonded cloths hereof.

41 Claims, 10 Drawing Figures

Fig. 1
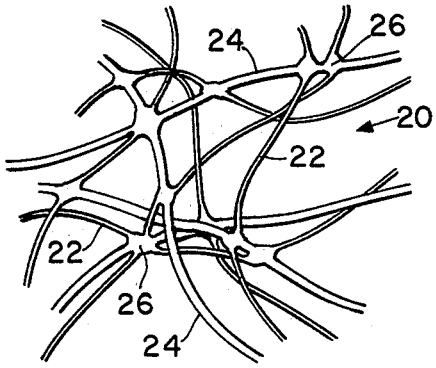
Fig. 2
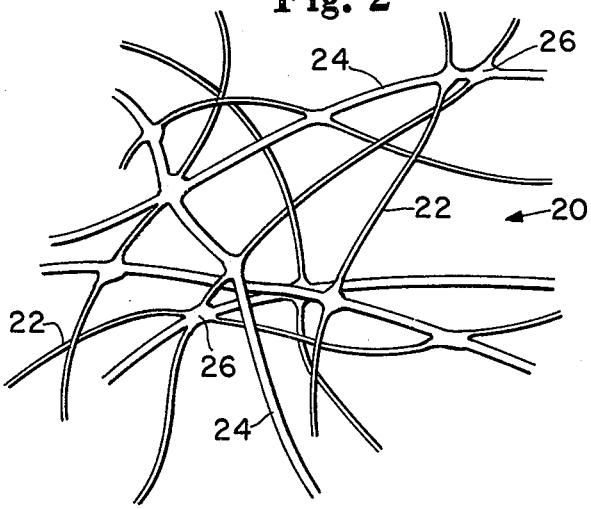
Fig. 6
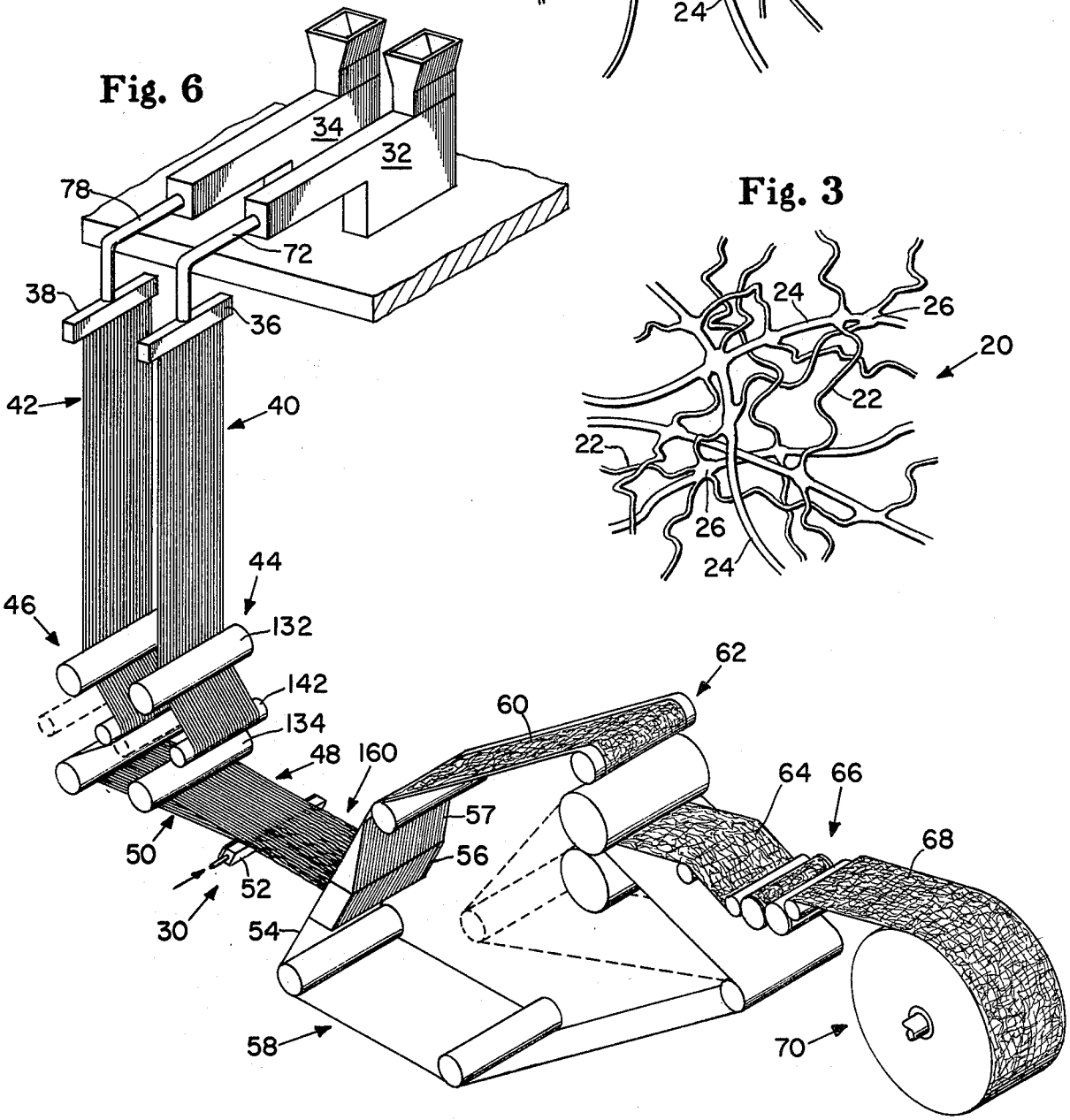
Fig. 3

Fig. 7
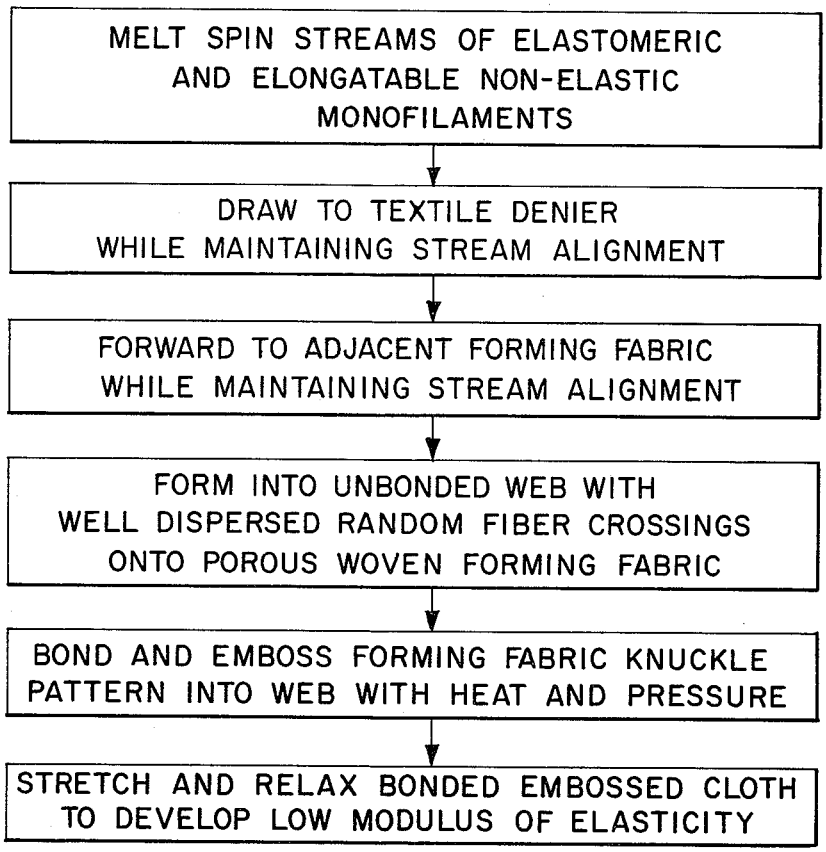
Fig. 14
Fig. 13
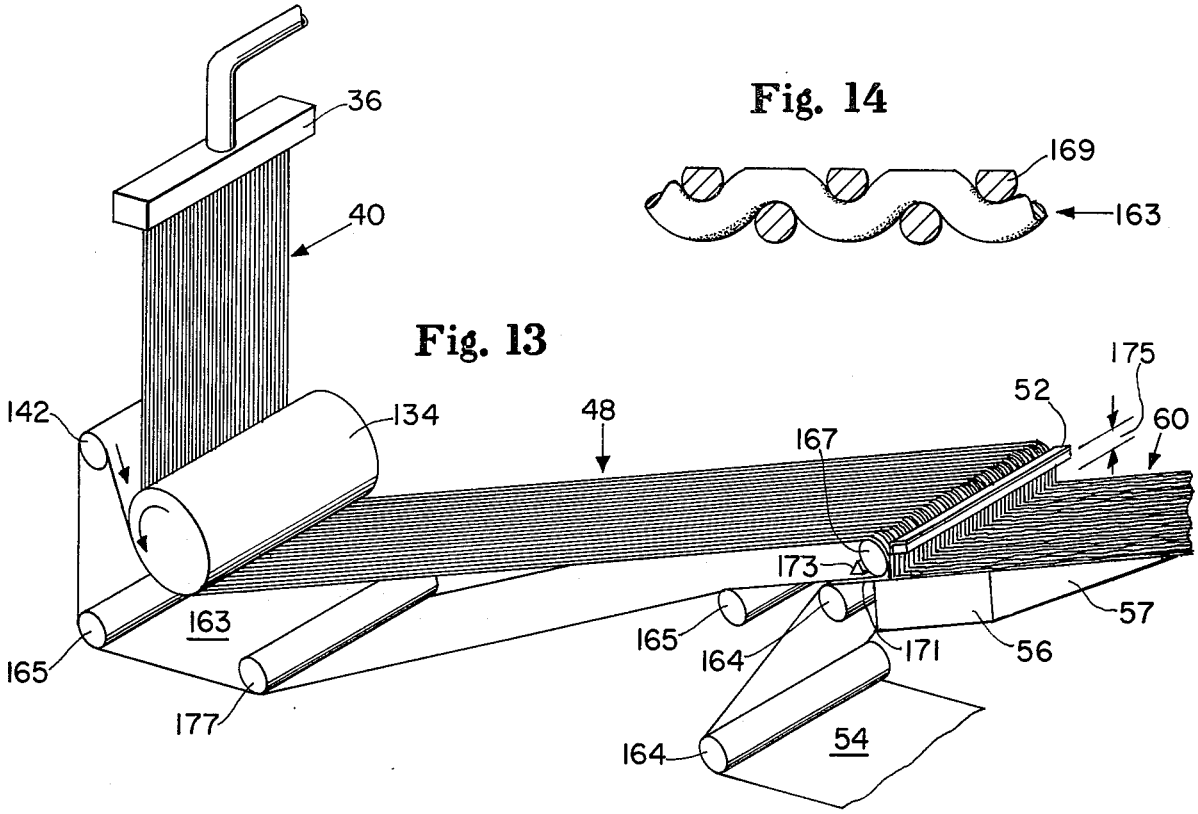

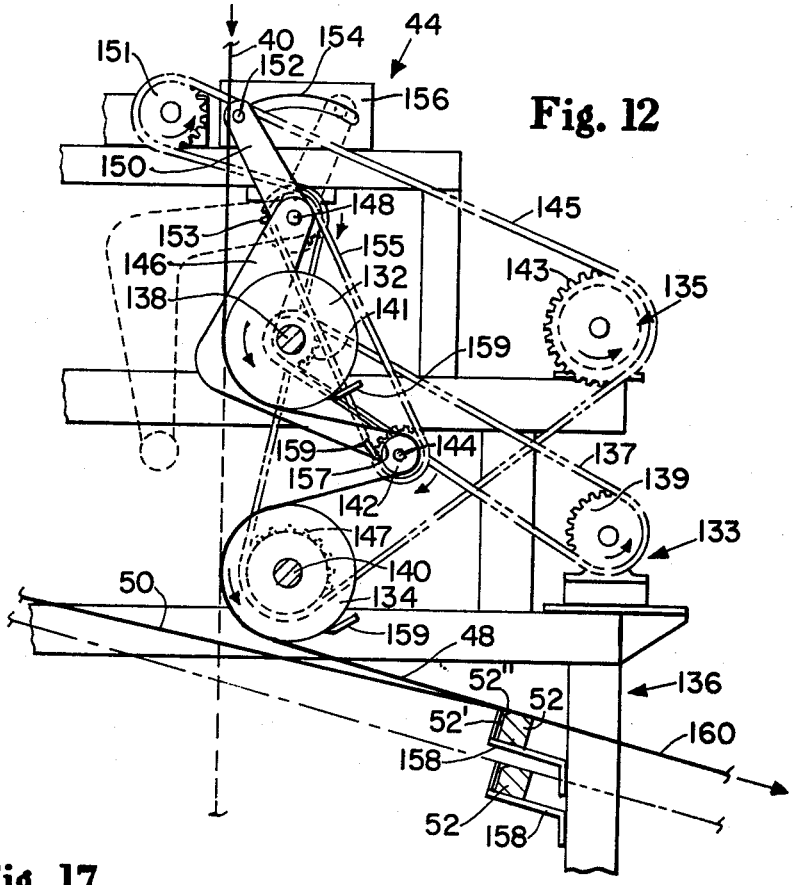
Fig. 12
Fig. 17
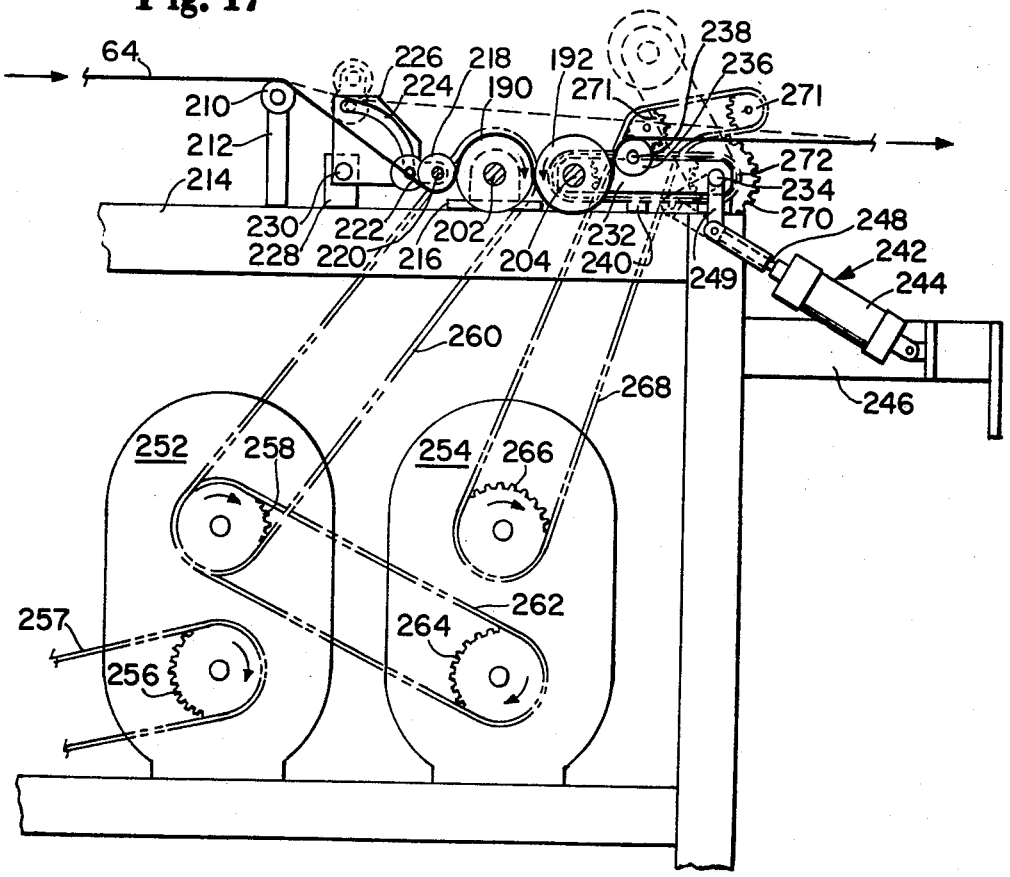

RANDOM LAID BONDED CONTINUOUS FILAMENT CLOTH

FIELD OF THE INVENTION

This application pertains to nonwoven fabrics and to the production of cloth comprising random laid and bonded fibers. More particularly, this application pertains to such cloth having improved and precisely controlled formation and to cloth of increased toughness and tear resistance. This invention is of particular utility in connection with the production of cloths of low basis weight and/or high porosity and/or of low modulus of elasticity in one or more directions having good draping qualities. This application and the invention hereof also pertain to the production and formation of continuous filaments therefore and to methods and apparatus for making same.

DESCRIPTION OF THE PRIOR ART

Cloth has heretofore generally only been made by one of three distinct processes; weaving, knitting, or felting. Each of these processes have their advantages and disadvantages, as do the cloths produced thereby. Each of these processes are similar in one respect, however, in that they rely primarily upon mechanical interengagement of fibers or filaments for providing structural integrity to the cloth. Bonding agents have heretofore been added to such cloths, particularly to felts, but such agents generally inherently produce increased stiffness and loss of drapability.

The generally slow production rates and complexity of the apparatus necessary to produce woven and knitted cloth, and the resulting high costs have lead to increased production of fabrics by processes akin to felting, producing fabrics generally referred to as "nonwoven". The American Society for Testing Materials has defined "nonwoven fabrics" as "a structure of fibers held together with a bonding material" and such fabrics have been heretofore produced by a number of processes, including by using random laid melt spun continuous filaments.

Various methods and apparatus have heretofore been suggested for transporting the melt spun filaments to a formation surface but such previously suggested methods and apparatus have not provided precise control of the individual filaments, depending instead primarily upon bulk transfer mechanisms, such as fluid streams having the filaments entrained thereon, elastrostatic changes, and the like. Hence, while an overall randomness has been achieved by such techniques controlled handling of individual filaments and the precisely controlled laydown of individual filaments has not heretofore been achieved.

Various bonding techniques have been heretofore suggested for bonding the filaments into a coherent fabric, including both autogenous and adhesive bonding, as well as spot bonding.

Again, however, the bonding techniques of the prior art have been based upon bulk characteristics since precise control of individual filament laydown has not been heretofore capable of achievement. Hence, without precise control of filament laydown and positioning, precision of bonding had no meaning.

Such heretofore available nonwoven fabrics are, however, relatively inexpensive as compared to conventional knitted or woven fabrics and while inferior to such conventional cloth in most respects have because of their lower cost been highly successful for certain end uses such as "disposable" products, particularly in the medical field where function and disposability are more important than appearance and comfort. Such heretofore available nonwoven fabrics have generally been stiff and boardly, lacking the handling, drape and appearance characteristics of conventional knitted and woven cloth. Further, such non-woven fabrics as have been heretofore available have generally lacked toughness, and tear resistance has generally only been achievable in heavy weight fabrics, and with increased stiffness. Hence, herefofore available nonwoven fabrics have been generally unsatisfactory as substitutes for conventional cloth in the "durable" market and have been accepted in the "disposable" market primarily because of their lower cost.

Heretofore, bonded cloth, produced as a nonwoven fabric, has not been available having the drape, hand, appearance, elasticity and strength of knitted and woven cloth.

OBJECTS OF THE INVENTION

Bearing in mind the foregoing, it is a primary object of the present invention to provide novel methods and apparatus for efficiently and economically producing bonded cloth and bonded cloth produced thereby.

Another primary object of the present invention, in addition to the foregoing object, is the provision of bonded cloth by the collection on a porous forming surface of one or more layers of fiber or filament material, at least one of which is randomly dispersed thereon with frequent random fiber crossings, bonded at at least some of said crossings and of methods and apparatus therefore.

Another primary object of the present invention, in addition to each of the foregoing objects, is the provision of novel methods and apparatus for enabling precisely controlled formation of nonwoven fabrics and the provision of precisely formed nonwoven fabrics.

Another primary object of the present invention, in addition to each of the foregoing objects, is the provision of nonwoven fabrics of precisely controlled fibers, laid down from precisely controlled focii, with precisely controlled excursions therefrom and generally symmetrically thereabout.

Another primary object of the present invention, in addition to each of the foregoing objects, is the provision of such bonded cloth wherein the bonding is autogenous and of methods and apparatus therefore.

Yet another primary object of the present invention in addition to each of the foregoing objects, is the provision of such bonded cloth, particularly sheer and lightweight cloth, bonded while still supported on the forming surface and of methods and apparatus therefore.

Still another primary object of the present invention, in addition to each of the foregoing objects, is the provision of such cloth wherein such forming surface is a woven fabric having generally uniform height preferably although not necessarily rounded knuckles and wherein such bonding is effected by passage of the forming fabric and the supported fiber or filament material through a bonding nip to provide a high bonding pressure at the forming fabric knuckles and methods and apparatus therefore.

Yet still another primary object of the present invention, in addition to each of the foregoing objects, is the provision of nonwoven fabric substantially autogenously bonded after precise formation, without disturbance of the fibers after laydown on a forming surface and during transport to the bonding nip.

Yet another primary object of the present invention, in addition to each of the foregoing objects, is the transport of a formed nonwoven web to a bonding location without draw thereof and without disturbance of the formation.

Still another primary object of the present invention, in addition to each of the foregoing objects, is the provision of such bonded cloth wherein at least one roll of the bonding nip is heated, and methods and apparatus therefore.

Yet still another primary object of the present invention, in addition to each of the foregoing objects, is the provision of such bonded cloth wherein a heated fluid, such as heated air or steam is provided or developed at the bonding nip to provide more uniform heating of the bond points, and methods and apparatus therefore.

A further primary object of the present invention, in addition to each of the foregoing objects, is the provision of such bonded cloth comprised of at least two types of filaments, at least one of which is relatively elastomeric, and methods and apparatus therefore.

A yet further primary object of the present invention, in addition to each of the foregoing objects, is the provision of such bonded cloth mechanically worked, as by stretching followed by relaxation, subsequent to bonding, to develop a low modulus of elasticity in at least one direction, and methods and apparatus therefore.

A yet further primary object of the present invention, in addition to each of the foregoing objects, is the provision of bonded cloth by the melt spinning of one or more streams of continuous filaments and simultaneous continuous drawing thereof to textile denier followed by forwarding thereof in mixed or layered configuration to a porous collection surface whereat at least one of them is dispersed and random laid to provide frequent random filament crossings and thereafter bonding the filaments at at least some of such crossings to provide a coherent cloth web, and methods and apparatus therefore.

Another and still further primary object of the present invention, in addition to each of the foregoing objects, is the provision of such bonded cloth of at least two types of continuous filaments, at least one of which is relatively elastomeric to provide resiliency and toughness thereto, and at least one of which is elongatable and relatively non-elastic to provide strength and body thereto, and methods and apparatus therefore.

Still another and yet further primary object of the present invention, in addition to each of the foregoing objects, is the provision of cloth of at least two types of fibers having differing stretch characteristics permitting, under a given common percent elongation, of inelastic deformation in at least one type of fiber and elastic deformation in at least another type of fiber.

Yet another and still further primary object of the present invention, in addition to each of the foregoing objects, is the provision of such bonded cloth which has been mechanically worked after bonding by stretching followed by relaxation to develop a low modulus of elasticity in the direction or directions of stretch, and methods and apparatus therefore.

Still another and yet further primary object of the present invention, in addition to each of the foregoing objects, is the provision of novel methods and apparatus for efficiently and economically producing bonded cloth, and of bonded cloths produced thereby.

A yet further primary object of the present invention, in addition to each of the foregoing objects, is the production of bonded cloth by producing continuous filaments in a spaced apart generally linear array and delivering the filaments in such array to divergence points closely coupled to a formation surface and directing them in random or directed formation thereat.

Yet still another primary object of the present invention, in addition to each of the foregoing objects, is the production of bonded cloth by producing continuous filaments in an equally spaced apart generally linear array and delivering the filaments in the equally spaced generally linear array to divergence points closely coupled to a formation surface and directing them in random or directed formation thereat.

Yet still another primary object of the present invention, in addition to each of the foregoing objects, is the provision of novel apparatus and methods for delivering filaments in equally or nonuniformly spaced linear array to divergence points or focii closely coupled to a formation surface and directing the filaments therefrom to the surface in random or directed formation and with controlled excursion from the mean focii or projections of the divergence focii on the surface, and in novel cloths produced thereby.

Yet another primary object of the present invention, in addition to each of the foregoing objects, is the provision of nonwoven fabric comprising a plurality of generally continuous synthetic polymer melt spun filaments extending substantially entirely longitudinally thereof in a machine direction, each filament having a mean focus specifiable in location in a cross machine direction generally perpendicular the machine direction, and generally cyclic or random deviations from its mean focus overlapping the mean focus of at least one adjacent filament, such deviation of each filament being generally symmetric about the mean focus of that filament and having an ascertainable generally uniform maximum excursion from the respective mean focus location.

It is yet still another primary object of the present invention, in addition to each of the foregoing objects, to produce synthetic polymer filaments subsequently bonded to produce the cloth of the present invention which are melt spun through relatively large spinnerette orifices as monofilaments and are mechanically drawn therefrom and reduced to textile denier by draw roll apparatus.

It is a yet further primary object of the present invention to provide nonwoven elastic cloths and materials of high porosity, even in cloths having heavy weights and of large caliper.

It is a feature of the present invention that the fibers of a nonwoven fabric in accordance herewith each have precisely controlled focii of laydown and precisely controlled excursion therefrom.

It is another feature of the present invention that the focus of a specific filament may be precisely controlled and held constant or varied, as desired, as can be the excursion of the filament therefrom. The extent of excursion of a filament from its focus is a factor of coupling between the focus and the surface, the degree of over-run of the filament on the surface, and the denier and fiber modulus or flexibility, and the basis weight of the fabrics, and in accordance herewith is generally symmetric about the focus.

It is another feature of the present invention that cloths of substantially any desired weight, for example from about 3–200 grams per square meter and preferably between about 10–150 grams per square meter may be made hereby.

It is another feature of the present invention that the bonded cloth produced in accordance herewith may be tailored to provide substantially any desired drape and hand characteristics and the appearance and characteristics of woven or knitted cloth, as desired.

It is yet another feature of the present invention that the bonded cloths produced in accordance herewith are of exceptional toughness and tear resistance and may provide either high dimensional stability and/or one or two way stretch characteristics, as may be desired.

It is still another feature of the present invention that a nonwoven elastic cloth suitable for use in lingerie may be economically produced hereby.

It is still another feature of the present invention that cloths having the caliper and elasticity of both lightweight lingerie type fabrics and heavy, strongly elastic webs similar in elasticity to conventional narrow elastic, such as are used in waistbands, and the like, can each be produced as desired, with the methods and apparatus of the present invention.

The invention resides in the combination, construction, arrangement and disposition of the various component parts and elements incorporated in new and improved apparatus for producing bonded cloth, the methods involved therein and the cloth produced thereby in accordance with the principles of this invention. The present invention will be better understood and objects and important features other than those specifically enumerated above will become apparent when consideration is given to the following details and description which, when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention, cloth having superior formation, strength, toughness and tear resistance is produced on a continuous basis by simultaneously melt spinning a stream of filaments of fiber forming synthetic organic polymer from an extruder through a die or a spinnerette, preferably a generally linear die with the spinnerette apertures arranged in a generally linear pattern. The filaments are then preferably immediately mechanically reduced to textile denier by being drawn by a draw roll or a set of draw rolls or by one or more belts extending therearound positioned in generally planar alignment with the spinnerette aperture centerline plane. The drawn filaments are then forwarded by forwarding means such as the belt or belts or by air aspirators to random or directed formation onto a moving porous forming surface passing across a vacuum box. Following laydown or collection of the filaments on the forming surface the cloth is bonded, as by passage of the unbonded web through a heated nip.

In accordance with one aspect of the present invention, a stream of filaments is melt spun through a linear spinnerette having a plurality of spinnerette orifices or rows of orifices offset to enable interleaving of the extruded filaments into a planar single row stream of filaments which are mechanically drawn to textile denier while still arranged in such single row stream on a draw roll having its surface in alignment with the axis of the spinnerette and then forwarded in such single row stream to divergence locations closely coupled with a porous collection surface whereat the filaments are dispersed randomly or in directed formation onto the porous collection surface. In accordance with this aspect of the invention the controlled spinning, drawing and forwarding and the close coupling provides a precisely defined focus of laydown for each filament in the stream and a limited and controlled excursion of each filament generally symmetric about its focus. The focus for each filament, or the medial or central point in its excursion is defined by the orifice position as maintained or specifically modified by the forwarding means. The degree of excursion of each filament from its focus is determined and controlled by the rate of over-run of the filament forwarding means relative the rate of travel of the collection surface, the denier and fiber modulus of the filaments, as well as by the basis weight of the completed web and the air flow through the collection surface. Positive and precise control of each filament until carried to a divergence point or focus close to the formation surface is the essence of this aspect of the invention.

In accordance with another aspect of the present invention, the forming surface comprises a woven fabric having a textured generally uniform knuckle pattern and is passed through the nip with the unbonded cloth web still supported thereon to provide spot bonding thereof at the knuckle points. Exceptionally uniform formation, even of very sheer and lightweight cloth or of very heavy weight cloths, from about 3–200 grams per square meter and preferably from about 10–150 grams per square meter may be achieved thereby. The positive transport provided by the woven fabric maintains the fiber location as formed, without stretch or draw of the formed web.

In accordance with still another aspect of the present invention, at least one and preferably at least two separate streams of monofilaments of one or more fiber forming synthetic organic polymers are melt spun through one or more preferably linear dies or spinnerettes from one or more extruders. The stream or the separate streams of filaments are then drawn or drafted by a draw roll for each stream to textile denier prior to forwarding to the forming surface. Forwarding may be accomplished by separate forwarding means for each stream, if plural streams are formed, such as air aspirators or belt means to provide a layered web on the forming surface or by a single forwarding means, such as an air aspirator or a single belt means to mix and intermingle the filaments prior to collection thereof on the forming surface. Any desired degree of molecular orientation of the filaments may be produced, if desired, during passage thereof through the draw roll set. One or more of the streams of filaments may be randomly looped and dispersed on the forming surface to provide frequent random fiber crossings.

The filament forwarding, in accordance with the present invention, whether by belts, air aspirators, or combinations thereof is, however, positive and precisely controlled for each individual filament, by positive draw of each filament to the formation point. Prior art air streams used to melt blow or convey filaments have been based upon entrainment of the filaments within a stream of air generated at one location and directed, with the entrained filaments to a distant formation location. Any turbulence in the airstream was destructive of the desired smooth flow of filaments but could not be totally avoided. Hence, the specific location of an individually specified filament at the distant formation point could not be precisely specified, but could only generally or statistically be determined.

In accordance herewith, however, the control and forwarding of each filament to the divergence points or focii closely coupled to the collection surface is precisely determinable and each filament has a precise focus at a precise close distance from the collection surface and diverges from its focus only within the close distance separating the focus from the collection surface. Such precise control of position of the filaments from initial extrusion until release at its focus is achieved by positive draw and forwarding thereof to the formation focus point adjacent the collection surface, as by rolls, belts, air aspirators, or the like. When air aspirators are used, they have the advantage over the fluid conveying systems of the prior art in that air aspirators can draw, rather than blow the filaments, and can maintain a pressure on the filaments which increases in the downstream direction, to provide a constantly increasing pressure gradient or positive tension on the filaments throughout their travel, when the aspirator is positioned at a downstream location.

In accordance with yet another aspect of the present invention there may also be provided a cloth structure comprised of at least two types of preferably continuous filaments, at least one of which is relatively elastomeric and at least one of which is elongatable but relatively non-elastic, at least one of which is dispersed to provide frequent random fiber crossings at least some of which are bonded, either directly or indirectly and preferably autogenously, to form a coherent cloth; and subsequently mechanically working the bonded cloth, as by stretching the bonded cloth, preferably substantially and uniformly in at least one direction followed by substantially complete cloth relaxation to develop a low modulus of elasticity therein in at least such one direction. While some molecular orientation may occur to the relatively non-elastic filaments during drawdown from the spinnerette to textile denier, it is important to this aspect of the invention that full molecular orientation not occur so that stretching of the relatively non-elastic filaments may be accomplished during the final stretching of the bonded cloth. Accordingly, for maximum toughness and tear resistance of the final cloth, preferably little or no molecular orientation is induced during drawdown from the spinnerette. It is also within the ambit of the present invention, however, to provide some degree of molecular orientation of the relatively non-elastic filaments prior to final working or stretching of the bonded cloth, either during drawdown and diameter reduction from the spinnerette or during passage of the filaments through the draw roll set, providing enough potential molecular orientation remains in the filaments to enable final stretching of the cloth without breaking the filaments.

The cloth produced in accordance with this aspect of the present invention, is, in fact, elongatable in all directions, even as bonded and prior to any preworking due to the presence of randomly dispersed elastomeric filaments. The cloth will give, without tearing and quickly recover to substantially its original dimension, developing low modulus elasticity. In its "as bonded" condition, and prior to any mechanical working, the cloth has a very high elastic modulus. Once stretched and relaxed, however, the elastic modulus for succeeding stretch cycles in the same direction is substantially reduced. Hence, by directional working or stretching under controlled loads followed by relaxation, a directionally oriented elasticity of low modulus can be readily developed in any desired direction and the cloth may be selectively developed thereby as a one-way or a two-way stretch material. By selection of polymers; filament size and relative proportions; fabric weight; bonding patterns, temperatures and pressures; degree of calendering; and pre-work conditions; the cloth of the present invention may be made in accordance herewith having characteristics, for example, of either knit or woven conventional cloth materials, or characteristics unique to the cloth structure hereof. The elastic modulus may also be tailored to provide soft and supple readily stretchable cloth or cloth having the modulus of conventional narrow or wide elastics or the modulus of two-way stretch materials. Even in very heavy weight elastic cloths, however, porosity may be maintained and up to about 90% of the material may be elastomeric, with the remaining as little as 10% non-elastic yet eliminating any rubbery feel thereof in the completed cloth.

Moreover, although the cloth of this aspect preferably is of uniformly dispersed random oriented filaments, directionability to the filaments may also be provided without departing from the scope hereof, as may nonuniform distributions of the filaments.

The cloth of this aspect of the present invention is preferably comprised of relatively elastomeric filaments and elongatable but relatively non-elastic filaments dispersed or directed and laid as superposed layers or as a mixed layer to provide numerous well dispersed fiber crossings weld bonded by the application of heat and pressure to at least some of the fiber crossings to provide a coherent bonded nonwoven cloth. Preferably, the relatively elastomeric and the elongatable but relatively non-elastic filaments are continuous filaments of synthetic fiber forming polymers extruded and mechanically drawn to textile denier and immediately forwarded and laid on a porous forming surface over a vacuum box.

Following bonding, the cloth produced in accordance with this aspect of the invention is stretched, preferably incrementally, as by passage over a set of differentially driven closely spaced apart stretch rolls and relaxed to develop a low modulus of elasticity substantially limited to the machine direction.

The weld bonded coherent cloth when so formed, then stretched in at least one direction and relaxed develops a low modulus of elasticity as the relatively elastomeric filaments retract the cloth to its approximate original area dimensions together with a suppleness and a soft feel and hand as the elongatable but relatively non-elastic filaments, relatively permanently elongated by the stretching, are looped, bulked and bunched between the bond points by the retracting relatively elastomeric filaments.

At the core of one aspect of the invention lies the unexpected fact that certain relatively unoriented thermoplastic fibers can be bonded to each other and to elastic fibers and at a bond strength which is sufficient to enable the non-elastic fibers to be stretched between said bonds without, in the majority of instances, breaking those bonds.

It will therefore be apparent that although the preferred process is one employing essentially continuous filaments, it is equally possible to carry out the invention with mixtures of non-elastic staple length fibers formed into webs by such techniques as carding or air layering well known in the art which webs can then be bonded autogenously or with separate binders to yield products within the scope of this aspect of the invention. Similarly, it will be apparent that the same mixture of fibers cut to lengths suitable for web forming on paper machines could also be bonded, stretched and relaxed to form products of the invention.

In addition to being elastic and thus convertible into form fitting garments, such cloth can be produced with weight, porosity, strength, modulus, thickness, suppleness, resiliency, hand, and/or visual and surface properties adjusted to meet a number of specific cloth material end use requirements.

Although the filaments may be bonded in smooth heated roll nips to bond substantially all of the filament crossing points and meet the elastic definition of the material, spot bonding at selected intervals may be utilized to alter the hand of the elastic cloth over rather wide limits. Differing emboss or bond patterns may texture the cloth material to provide appearance and feel of differing conventionally woven or knitted fabrics. Bond frequency, at least within a range of 28–10,000 bond points per square inch, does not appear to appreciably effect the strength or elastic properties of the cloth hereof, but can effect the appearance and feel of the cloth. Hence, close spacing of the bond points produces little lofting of the elongated non-elastic filaments and a low caliper cloth while further spaced apart bondings may produce substantial lofting of the elongated non-elastic filaments and a highly fuzzy or napped cloth of high caliper (at low pressure caliper measurements).

As heretofore pointed out, porous elastics of high elastomeric content, as high as about 90% and of high basis weights, as high as about 200 grams per square meter can be produced in accordance with this aspect of the present invention. Very supple and soft cloths may also be made, particularly at much lower basis weights and elastomeric content, preferably about 20 to 65% elastomeric fiber content.

By "relatively elastomeric" and "relatively non-elastic" it is meant, for the purposes hereof, that the fiber selection is such as to provide differential stretch characteristics permitting, under a given common percent elongation at least some elastic (non-permanent) deformation of the relatively elastomeric fiber or fibers and at least some inelastic (permanent) deformation in the relatively non-elastic fiber or fibers.

When such a cloth is mechanically worked after bonding, as by stretching to substantially exceed the elastic limit of the relatively non-elastic fibers without exceeding the elongation to break of either filament and then relaxed, only the relatively low modulus of the relatively elastomeric filaments resists the next cycle of extension until the first cycle extension length is reached. This low modulus of elasticity in the direction or directions of stretch and high modulus at the extension limit defined by the first cycle stretch can be used to provide comfortable fit of garments fabricated therefrom coupled with high ultimate strength.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows certain preferred embodiments or modifications of the present invention and what is presently considered and believed to be the best mode of practicing the principles thereof and wherein:

FIG. 1 is a schematic diagrammatic representation of a portion of a cloth made in accordance with the principles of the present invention as bonded, and prior to stretching;

FIG. 2 is a schematic diagrammatic representation similar to FIG. 1 showing the cloth of FIG. 1 expanded generally uniformly in all directions to stretch the fibers thereof;

FIG. 3 is a schematic diagrammatic representation similar to the preceding figures illustrating the cloth relaxed, after stretching, with the relatively elastomeric filaments thereof retracted and the relatively non-elastic filaments thereof bunched and looped thereby;

FIG. 6 is a diagrammatic illustration of apparatus in accordance herewith for making the cloth of the present invention and in accordance with the methods herein;

FIG. 7 is a flow chart of the process steps for making the cloth of FIGS. 4–5 with the apparatus of FIG. 6;

FIG. 12 is an enlarged side elevation illustration of one of the draw roll air forwarding sections of the apparatus of FIG. 6, showing the details thereof;

FIG. 13 is a diagrammatic illustration view similar to FIG. 6 of another filament drawing and forwarding apparatus in accordance with another aspect of this invention;

FIG. 14 is an enlarged illustration of a portion of the forwarding belt of the apparatus of FIG. 13;

FIG. 17 is an enlarged side elevation view similar to the preceding figures of the incremental stretching section of the apparatus of FIG. 6, showing the details thereof;

DEFINITIONS

Figure 4:
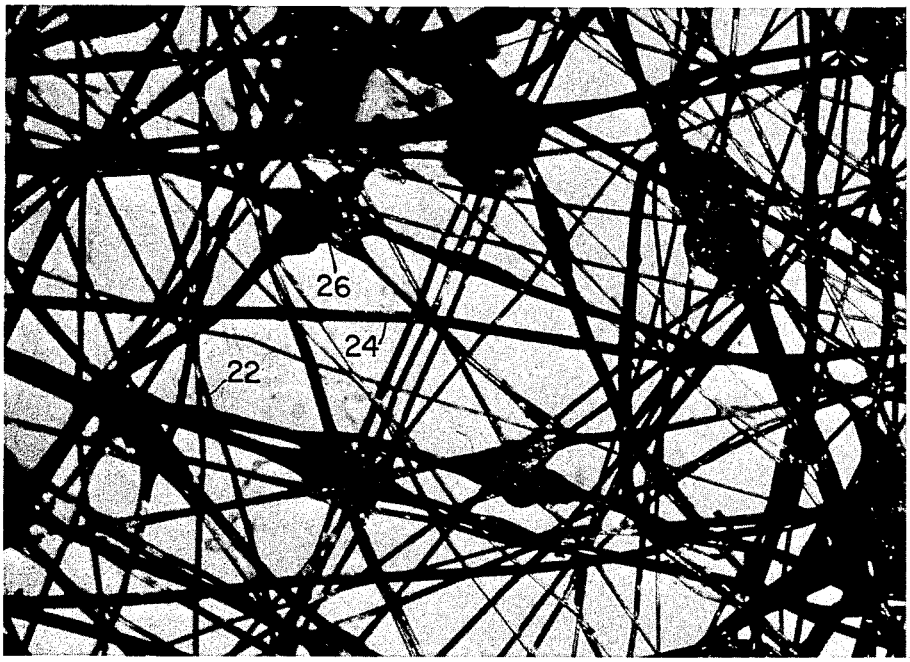
FIG. 4 is a photomicrograph at approximately 41X of an actual cloth material made in accordance with the present invention, as bonded and prior to stretching.

In this specification and in the subjoined claims, certain terminologies and words of art have been used which may be subject to multiple interpretations. In each such case, the generally accepted usage thereof is intended, where not contradictory to the following specific definitions which are included herein to clarify, without limitation thereby, the exact meaning intended herein.

A fiber is defined for the purposes hereof as a pliable, cohesive, threadlike object having a length to width ratio exceeding 100 to 1 and formed of a thermoplastic polymer.

A filament is defined for the purposes hereof as a single continuous man-made fiber having an extreme length.

A continuous filament is defined for the purposes hereof as a single continuous filament as melt spun and not intentionally broken or cut.

A staple length fiber is defined for the purposes hereof as a filament cut to approximately 1–6 inches in length.

Textile denier fiber is defined for the purpose hereof as approximately 1–15 denier.

A short cut fiber is defined for the purpose hereof as a filament cut to less than 1 inch in length, and typically from ¼ to 1 inch in length.

A fiber forming polymer is defined for the purpose hereof as an organic thermoplastic polymer that can be melt spun to form a filament.

Melt spinning is defined for the purpose hereof as the process in which a fiber is formed by the extrusion of a melted polymer into a cooling zone as opposed to wet spinning (extrusion of a solution into a coagulating bath) or dry spinning (extrusion of a solution to form a fiber by evaporation of the solvent).

A monofilament is defined for the purpose hereof as a filament exceeding 15 denier.

An elastomeric fiber is defined for the purpose hereof as a polymer in fiber form which exhibits less than 10% permanent increase in length along the fiber after 50 short interval (less than 1 minute/cycle) cycles of extension to 150% of original length or, for example, extension from 2 to 3 inches length.

A non-elastic fiber is defined for the purpose hereof as a polymer in fiber form which after stretching along the fiber to 150% or more of original length (for example from 2 to 3 or more inches) at a temperature between room conditions (70° F) and the glass transition temperature of the polymer and subsequent releasing of the fiber results in a permanent elongation equal to 50% or more of the stretch applied.

Random laid is defined for the purpose hereof as a process of formation of nonwoven fabrics by forwarding fibers or filaments to a location spaced apart from a collection surface and thereafter laying down the fibers or filaments on the collection surface without instantaneous or precise control at all instants of the fiber or filament location relative the collection surface. The movements of the fibers or filaments are generally statistically determinable, with the instantaneous positions and flexings thereof being controlled by looping forces, Coriolis forces, Rayleigh movements, or the like.

Random fiber or filament crossings are defined for the purpose hereof as the crossings produced between random laid fibers or filaments and other random laid or non-random laid fibers, filaments or monofilaments.

DETAILED DESCRIPTION OF THE INVENTION

This invention relates to a cloth structure comprising preferably generally continuous melt spun organic polymer filaments dispersed and laid to provide frequent random filament crossings, subsequently bonded to form a coherent cloth. In accordance with one aspect of the present invention, a stream of filaments is melt spun through a linear spinnerette having a plurality of spinnerette orifices or rows of orifices offset to enable interleaving of the extruded filaments into a planar single row stream of filaments which are mechanically drawn to textile denier while still arranged in such single row stream on a draw roll having its surface in alignment with the axis of the spinnerette and then forwarded in such single row stream to divergence points closely coupled with a porous collection surface whereat the filaments are dispersed randomly or in directed formation onto a porous collection surface. In accordance with this aspect of the invention the controlled melt spinning, drawing and forwarding and the close coupling provides a precisely defined focus or divergence point for laydown of each filament in the stream and a limited and controlled excursion of each filament symmetrically about its focus. In accordance with another aspect of the present invention at least some of the dispersed filaments are random laid to form an unbonded web on a porous woven fabric having generally uniform knuckle heights and the unbonded web comprised thereof is carried while still on the fabric and together therewith through a heated bonding nip to emboss the fabric knuckles into the web, providing spaced apart spot bond points and a textured surface to the bonded cloth produced thereby. In accordance with yet another aspect of the disclosed invention, there are provided at least two types of preferably generally continuous filaments, at least one of which is relatively elastomeric, at least one of which is generally uniformly dispersed and random laid to provide frequent random filament crossings, at least some of which are bonded, preferably autogenously, to form a coherent bonded web. In accordance with yet still another aspect of this invention, such a coherent bonded web containing at least one relatively elastomeric filament type and one elongatable but relatively non-elastic filament type is then mechanically worked after bonding, as by stretching, to substantially exceed the elastic limit without exceeding the elongation to break of the relatively non-elastic filaments followed by relaxation of the elastomeric filaments to develop a low modulus of elasticity in the direction or directions of stretch. Yet still another aspect of this invention is the production of bonded cloth by control of the extent of orientation and extent of drawdown of melt spun filaments. Other aspects of this invention are methods and apparatus for producing the bonded cloths hereof.

With reference now to the drawing and particularly to FIGS. 1-3 thereof, there is shown and illustrated in enlarged diagrammatic and schematic form, a plan view of a representative portion of a cloth web 20 made in accordance with the present invention comprising, in accordance with one aspect hereof, at least two types of filaments, relatively non-elastic filaments 22 and relatively elastomeric filaments 24, dispersed to provide frequent random fiber crossings 26 whereat the filaments are bonded to one another, as by heat and pressure, to form the coherent bonded cloth web 20.

The relatively non-elastic filaments 22 and the relatively elastomeric filaments 24 are preferably, in accordance with another aspect of the present invention, continuous filaments extruded or melt spun through linear spinnerettes and subsequently mechanically drawn as they exit therefrom and reduced thereby to textile denier. The relatively non-elastic filaments 22 and the relatively elastomeric filaments 24 need not necessarily, however, comprise continuous filaments and may, for example, comprise, in whole or in part, staple or cut length fibers.

In accordance with the said one aspect hereof, the fibers, if not both substantially continuous filaments, should each be of sufficient length, however, as to permit, on the average, at least two bonded crossings with fibers of the other type. Each relatively elastomeric fiber or filament may preferably, therefore, in accordance herewith, be bonded either directly or indirectly with at least two relatively non-elastic fibers or filaments and each relatively non-elastic fiber or filament may preferably therefore, in accordance herewith, be bonded either directly or indirectly, with at least two relatively elastomeric fibers or filaments.

The bondings at the fiber crossings 26 are preferably autogenous, that is, produced by the application of heat and pressure alone and without any solvent or adhesive application. However, solvent or adhesive bonding can be utilized without departing from the present invention. Moreover, in accordance with the present invention, the relatively non-elastic filaments 22 and the relatively elastomeric filaments 24 may be bonded at each crossing point 26, or the cloth 20 may be spot bonded to bond only some of the crossing points 26 and, in accordance with one aspect hereof, provide an embossed surface to the cloth 20. The relatively non-elastic filaments 22 and the relatively elastomeric filaments 24 may also be either mixed within a single generally homogenous layer or may be formed as distinct layers, one above the other, laminated together. The filaments 22 and 24 may, further, be either single component filaments or may be multicomponent filaments made of mixed or co-extruded polymers or copolymers.

In accordance with the present invention, the cloth 20 may be produced by separately extruding or melt spinning streams of filaments of each polymer, separately drawing each stream of filaments to reduce the individual filaments thereof to textile denier and delivering the streams of filaments while maintaining the stream alignment and distribution by air aspiration or other positive forwarding means to divergence points closely adjacent a porous forming surface and thereat directing the textile denier filaments for looping and random or directed laydown and formation with well dispersed crossings on the forming surface, as over a vacuum box. The unbonded web produced thereby may then be bonded, preferably autogenously, to produce the bonded cloth structure illustrated in FIG. 1. This bonded cloth structure may then be expanded, as by stretching, to elongate both the non-elastic filaments 22 and the elastomeric filaments 24, to the configuration illustrated in FIG. 2.

When the stretched bonded cloth 20 is released, the elastomeric filaments 24 retract the cloth to approximately its original area dimensions. The non-elastic filaments 22, however, do not retract and the retraction of the elastomeric filaments 24 is effective to cause looping, bulking and bunching of the non-elastic filaments 22, as shown in FIG. 3, as the bond points 26 return to substantially their original positions.

Following stretching and relaxation, therefore, the cloth 20 has a low modulus of elasticity in any direction wherein it was previously stretched and relaxed, within a range of extensions up to the limit of extension to which the cloth had been previously expanded. Within this range, only the elastomeric filaments 24 need be stretched during subsequent stretch cycles and the non-elastic filaments 22 need be merely straightened. Hence, the modulus of elasticity is substantially entirely that of the previously stretched elastomeric filaments 24, and the cloth exhibits true elasticity.

The non-elastic filaments 22 add body to the cloth structure as well as increasing its opacity. Further, the looped and bunched non-elastic filaments 22 provide a soft nap to the cloth structure, eliminating the sticky or tacky feel of the elastomeric filaments. The non-elastic filaments 22 also limit the stretch characteristics so that the cloth is not easily deformed beyond the elastic range built in by the initial stretching thereof used to develop its low modulus of elasticity. As heretofore pointed out, the elastomeric and non-elastic filaments may be mixed in a generally homogenous layer. An elastomeric filament layer may be laminated between a pair of non-elastic filament layers, or vice versa. Additional layers, including cut length fiber layers and/or cellulosic or wood pulp layers may also be incorporated into the cloth, without departure from the principles of the present invention. Yet further, the looped and bunched non-elastic filaments may be set by embossing during bonding or as a post bonding step to provide a surface appearance similar conventionally knit or woven cloth.

As has been herein elsewhere pointed out, it is also an aspect of the present invention to provide such embossing, particularly during bonding (although it is also within the ambit of this invention to provide embossing as a separate step) by collecting the dispersed filaments on a porous woven forming fabric having generally uniform knuckle heights and passing the forming fabric and supported filaments through a pressure bonding nip to emboss the forming fabric knuckle pattern into the collected filaments while bonding them into a coherent bonded cloth. In accordance with this aspect of the invention, very sheer and lightweight cloths of either a single type of filament, or of mixed elastomeric and non-elastic filaments may be produced.

As has been heretofore pointed out, the mixed or dual filament (i.e., comprising both elastomeric and elongatable but non-elastic filaments) cloth 20 of the present invention may be mechanically worked to develop a low modulus of elasticity in either a plurality of directions, through stretching or expansion in such plurality of direction or in only a single primary direction through stretching in only a single direction, followed by relaxation to produce a cloth having two-way and one-way stretch characteristics, respectively.

Bi-directional expansion (as schematically illustrated in FIG. 2) may be achieved in a number of ways. Uniformity of expansion, simultaneously in at least two mutually perpendicular and generally uniformly and incrementally in all directions may even be achieved to provide uniform ommidirectional characteristics, by way of example only, by sandwiching the cloth 20 between soft elastomeric or rubber blocks and compressing the sandwich, as by a platen press to expand the sandwich transversely the press pressure application direction. Unidirectional stretching may be achieved by a stretch frame, or for uniform expansion, in closely spaced apart differentially driven stretch rolls, as will be described in more detail hereinafter.

Figure 5:
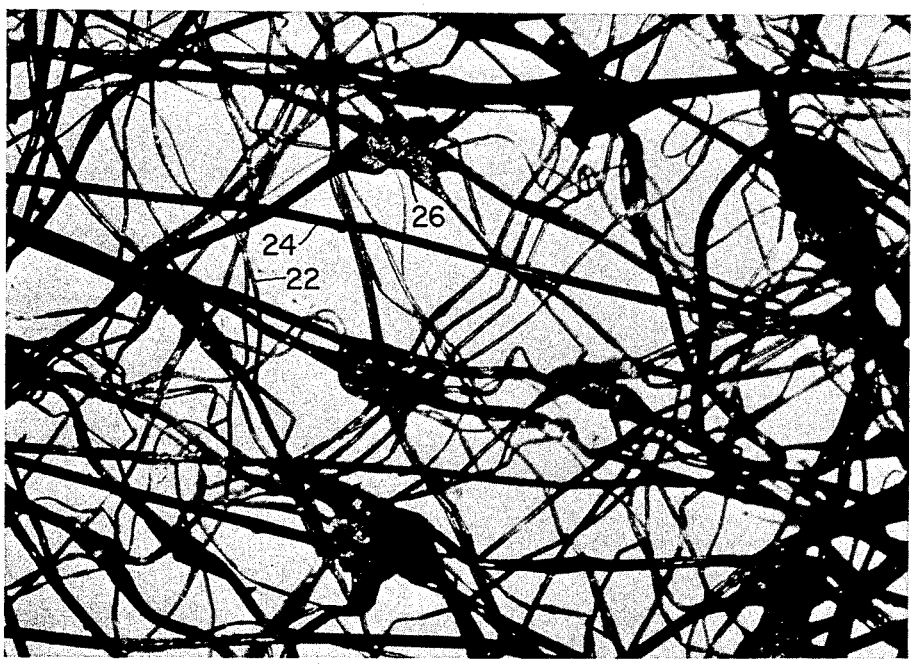
FIG. 5 is another photomicrograph similar to the preceding figure and at the same magnification, showing the cloth material of the preceding figure relaxed after incremental unidirectional stretching generally in the direction appearing horizontally in the figure.
Figure 8:
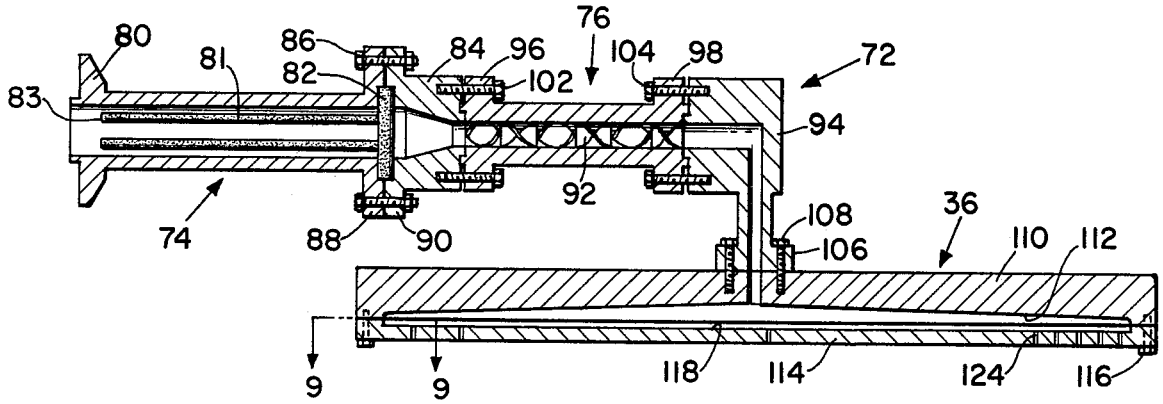
FIG. 8 is an enlarged elevational cross section illustration of one of the extruder heads and the linear die head or spinnerette shown schematically in FIG. 6, showing the details thereof.
Figure 9:
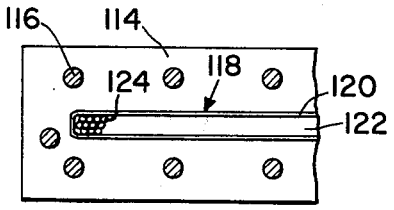
FIG. 9 is an enlarged plan view of a portion of the die head of FIG. 8 taken along line 9—9 of FIG. 8.

FIG. 4 is a photomicrograph, at about 41X enlargement, of an actual bonded cloth having elongatable but non-elastic filaments 22 and elastomeric filaments 24 in accordance with the present invention and similar to that schematically shown in FIG. 1. The cloth shown in the photomicrograph, FIG. 4, comprises continuous poly(ethylene terephthalate) polyester filaments defining the non-elastic filaments 22 and continuous polyester based polyurethane filaments defining the elastomeric filaments 24. The polyester filaments 22 and the polyurethane filaments 24 were melt spun, drawn, collected, laminated and bonded as described hereafter in Example I. The cloth was then incrementally stretched through a pair of differential stretch rolls, as described hereinafter, in the horizontal direction (having reference to the orientation of the cloth in FIGS. 4 and 5) and allowed to return to its relaxed condition. FIG. 5 is a photomicrograph, taken under similar conditions to that of FIG. 4, of the cloth in its relaxed condition, after such unidirectional stretching. The cloth of these figures was bonded by passage through a heated bonding nip while supported by a woven forming fabric, as described herein, to produce the spaced apart bond spots 26.

EXAMPLE I

A nonwoven elastic cloth with excellent drape and hand was made from poly(ethylene terephthalate), also referred to as PET, polyester and polyester type polyurethane filaments in the following manner:

A capillary rheometer (a piston and cylinder device conventionally used to test laminar fluid flow through a capillary tube under controlled conditions)—Model A70, manufactured by the Instron Corporation, Canton, Massachusetts, was fitted with a steel die containing a short single cylindrical exit orifice having a diameter of 0.020 inches and a land length of 0.075 inches. The cylinder of this rheometer was heated to 270° C and filled with pellets of dried poly(ethylene terephthalate) or PET polyester resin VFR 3801 supplied by Goodyear Tire and Rubber Company, Chemical Division. VFR 3801 is a PET resin prepared by the catalyzed polymerization of ethylene glycol and terephthalic moiety well known in the art and having an intrinsic viscosity of about 0.62 as measured in 60% (wt) phenol/40% tetrachlorethane at 30° C at a concentration of approximately 4 grams per liter. The resin had been dried in a vacuum oven at 150° C and 30 inches Hg vacuum for 16 hours.

After drying, the resin was kept in sealed containers until heated. The rheometer piston was loaded to 100 psi pressure in the cylinder. At these conditions the rate of extrusion through the die was 0.18 grams per minute. The monofilament so formed was drawn vertically downwardly through ambient air and passed sinuously through a vertically aligned stack of three 6-inch diameter polished steel draw rolls placed about eight feet from and directly beneath the rheometer die. The surfaces of the rolls were about one-half inch apart and their axes were parallel and in vertical alignment. The filament path wrapped the first draw roll (the roll closest the die) about 85° and the second (the next roll) and third draw rolls (the roll farthest from the die) about 170°.

The filament was then drawn through an annular air aspirator—Transvector Model 501 supplied by the Vortec Corp., Cincinnati, Ohio. This aspirator comprises a plenum chamber for compressed air surrounding a ring shaped slot 0.002 inches wide leading about a 90° rounded turn to move an annular air jet by Coanda effect into a throat having an inlet opening of 0.038 inches and thence along a cylindrical cone frustrum downstream of the slot to maintain the supplied air as a laminar flow along said conical wall and produce an aspirating flow of air through the throat and an air amplification ratio therethrough of about 6.5. The aspirator was operated with compressed air at a pressure of 12 psi to produce a total air output flow through the aspirator of about 15 scfm.

This air flow through the aspirator forwarded the filament from the third draw roll and deposited it in random loops against a 30 × 36 mesh porous forming surface placed over a vacuum box operating at about 1 inch $H_2O$ vacuum and drawing air through the forming surface at a mean velocity between about 1500 and 2000 feet per minute.

The aspirator positively pulled the filament from the third draw roll and defined a specific focus or divergence point from which excursion and random movement of the filament contact point over the porous surface forming occurred. The aspirator was spaced apart from the forming surface about 2 feet and the excursions of the filament contact point on the collection or forming surface covered an area about one-half foot in diameter, defining an excursion cone from the filament focus point subtending about 14° at the apex.

The draw rolls were each operated at 1460 surface feet per minute to reduce the diameter of the melt spun monofilament to form a 3.6 denier filament and this filament was deposited on a 1 foot square section of the forming surface as a uniform layer over the entire section by manually altering the direction of the aspirator stream in a manner such as to deposit substantially equal amounts of filament on each section of the screen. In this manner a random laid unbonded web weighing 12 grams per square meter was built up on the forming surface.

The forming surface was a porous woven fabric of the type having generally equal height rounded knuckles and produced generally in accordance with the description embodied in U.S. Pat. No. 3,473,576 entitled "Weaving Polyester Fiber Fabrics" granted Oct. 21, 1969 to John S. Amneus and assigned to the assignee of the present application. The specific fabric of the forming surface was of plain weave, of approximately 12 mil diameter monofilaments. The forming fabric was initially sprayed with a release agent of the quarternary surfactant type, namely dialkyl dimethyl ammonium chloride.

Without removing the unbonded web so formed from the forming fabric the procedure was repeated using a polyester type polyurethane polymeric fiber forming elastomer, Texin 480A, a polyester and glycol-based polyurethane supplied by Mobay Chemical Company, Pittsburgh, Pa. Texin 480A is described in the pamphlet "An Engineering Handbook for Texin Urethane Elastoplastic Materials" published by Mobay Chemical Company in 1971 and can be prepared by means well known in the art as exemplified by the teaching of Schollenberger in U.S. Pat. No. 2,871,218 dated Jan. 27, 1959. The resin was dried at 100° C and 30 inches Hg vacuum for 4 hours. During polyurethane deposition conditions were altered to a rheometer cylinder temperature of 200° C and a cylinder pressure of 760 psi resulting in an extrusion rate of 0.07 grams per minute. The draw rolls were operated at a speed of 384 surface feet per minute to produce a 5.4 denier filament. The vacuum and aspirator pressures were unchanged, and the divergence cone angle was also substantially unchanged.

This filament was directed in a uniform pattern and formed on top of the polyester web previously formed until an additional weight of 12 grams per square meter was accumulated.

Finally, a second polyester web was formed over these two layers as in the first step at the same conditions as the first polyester layer and with the same polymer in the amount of an additional 12 grams per square meter.

This three layer unbonded web was then passed through a heated metal coated bonding roll nip at 10 feet per minute while still carried on the forming fabric. The roll pressure was 36 pounds per lineal inch. The roll contacting the web was heated to a surface temperature of 250° F. The opposing roll contacting the forming fabric was unheated.

The bonding press used was a "Hartig" hot pressure roll bonding nip having an unheated steel cold roll of 8 inch diameter and 14 inch length covered with rubber, 90 "A" scale Shore Durometer. The hot pressure roll was aluminum 7¼ inch diameter, 14 inch width and loaded with two 2 inch air cylinders.

It was found that the cloth thus formed was securely bonded at the pressure points corresponding to the knuckles of the forming fabric.

The opposite edges of this cloth were then placed in linear clamps and the cloth was stretched to 190% of its original length by pulling the clamps from 10 inches apart until they were 19 inches apart.

When released, it was found that this cloth was drawn back to nearly its original length by the elastomeric polyurethane filaments and that it was unusually supple for a random laid continuous filament bonded fabric, having the hand, finish and other characteristics generally of a lightweight conventional knit rayon jersey such as that conventionally used for lingerie.

EXAMPLE II

Another nonwoven elastic cloth with good opacity, smoothness, drape and hand was formed from three relatively non-elastic layers of polypropylene filaments and two layers of relatively elastomeric polyurethane filaments.

The layers were separately formed as substantially unbonded webs in the equipment described in Example I and subsequently laminated and bonded, as follows:

Rexene copolymer resin grade 44S3, an isotactic polypropylene resin containing about 3% ethylene-propylene elastomer resin and having a melt flow rate of 0.3 grams per minute at 230° C and supplied by Rexene Polymer Corp. of Paramus, New Jersey was blended with 0.1% Ultramarine Blue and 4.0% Titanium Dioxide and extruded from the capillary rheometer at 215° C cylinder temperature and 220 psi piston pressure through the 0.020 inch orifice, 0.075 inch land length die at a flow rate of 0.11 grams per minute. The monofilament so formed was drawn through the S-wrap draw roll set operated at 660 surface feet per minute for each roll to a 4.9 denier filament and that 4.9 denier filament was forwarded with the annular aspirator to form a randomly dispersed web of approximately 7 grams per square meter on the forming surface. The vacuum box and aspirator were operated at the condition set forth in Example I above.

Three such unbonded polypropylene filaments webs were formed and layered alternately with 10 gram per square meter unbonded polyurethane filament webs made as described in Example I from Texin 480A polyurethane melt spun at 0.08 grams per minute, at 199° C cylinder temperature and 1660 psi piston pressure; drawn at 256 feet per minute to form a 9 denier filament and forwarded to the forming surface with the annular aspirator and vacuum box operated as above.

The five layered web was placed on the 30 × 36 mesh forming fabric of Example I and pressed in a heated platen press at 300° F and 210 psi for 2 seconds on one side. The web was removed from the fabric and pressed again with the mesh fabric on the opposite side of the web at the same conditions.

The resulting material had a basis weight of 41 grams per square meter, a tensile strength in all directions to rupture of 3.9 pounds per inch of web width and an elongation to rupture of 183%.

After the web has been prestretched to 150% of its original length, the material exhibited perfect elasticity at 25% elongation in subsequent cycles and had a tensile modulus of 1.5 pounds at 25% elongation.

While only two specific examples of elastic cloths made in accordance with this invention have been detailed hereinabove, there is no intent hereby to limit the claimed invention thereby. A wide range of fiber forming elastomeric and non-elastic polymers are well known to those skilled not only in the textile and yarn forming arts, but in the general chemical arts as well, and any fiber forming polymers, within the specific definitions herein set forth and within the express language of the appended claims as defined hereby are intended to be within the scope and breadth of the subjoined claims. Further, while in Example I the resultant cloth comprised approximately 33% elastomeric filaments and while in Example II the resultant cloth comprised approximately 50% elastomeric filaments, cloths in accordance with the present invention may be made comprising approximately 10–90% elastomer and in basis weights of from about 3–200% grams per square meter without departing from the scope hereof.

It is a part of the present invention to provide means enabling production of such cloth in continuous webs. With reference now to FIGS. 6 through 18, inclusive, of the drawing there is therefore shown and illustrated therein apparatus, designated generally by the reference character 30, for the continuous production of dual type filament, one-way stretch cloth web in accordance with the present invention.

The apparatus 30 comprises a melt spinning section comprising a pair of extruders 32 and 34 for the non-elastic and elastomeric polymers, respectively. Each of the extruders 32 and 34 is provided with a generally linear die head or spinnerette, 36 and 38, respectively, for melt spinning streams of monofilaments 40 and 42, respectively. The spinnerettes 36 and 38 preferably produce the streams of monofilaments 40 and 42 in equally spaced apart linear arrays and the die orifices are preferably of relatively large diameter, being preferably of greater than about 0.007 inches in diameter although not necessarily round.

The streams of filaments 40 and 42 are preferably extruded vertically downwardly through ambient air, as shown, to a draw section where they are passed through draw roll sets 44 and 46, respectively, for mechanical drawing to reduce each filament to textile denier as the filaments are pulled thereby from the dies 36 and 38. The draw roll sets 44 and 46 are preferably independently driven so that the amount of pull down and diameter reduction of the filaments may be readily controlled or as may be desirable for certain end uses, draw down may be eliminated entirely for some of the filaments. After exiting from the draw roll sets 44 and 46, the streams of drawn textile denier filaments 48 and 50, respectively, are then delivered from the draw roll sets 44 and 46 to a distant formation section while maintaining the stream alignment and distribution, as by forwarding means such as a linear air aspirator or other forwarding device 52 and onto a preferably continuous porous collection or forming surface 54 passing, for example, across a vacuum box 56 in a forming section, designated generally by the reference character 58, to form an unbonded web 60. The forwarding velocity may provide dispersion and fiber distribution by looping and random laydown of the filaments 40 and 42 on the forming surface 54. As hereinafter detailed, other or additional forwarding and guiding means may be provided, including, by way of example only, positive filament supporting means, such as one or more carrier belts, as hereinafter described.

After laydown on the forming surface 54, the unbonded web 60 is bonded in a heated bonding nip 62 within the forming section 58 to produce a coherent autogenously bonded cloth web 64. The bonded cloth web 64 is subsequently passed through an incremental stretch roll section 66 to produce a one-way stretch elastic cloth 68 which is then wound onto a take-up roll 70.

The above sequence of steps is shown in the flow chart, FIG. 7.

With continued reference to FIG. 6, together now with FIGS. 8–11, the extruder and die apparatus for producing the streams of monofilaments 40 and 42 may now be described and detailed. The die head or linear spinnerette 36 is connected with the extruder 32 by connecting, filtering and homogenizing means 72 which comprises (FIG. 8) a filtering section 74 and a mixing section 76 to assure that only pure uniformly melted and blended polymer is fed to the orifices of the die head 36.

The die head or linear spinnerette 38 is connected with its associated extruder 34 by similar connecting, filtering and homogenizing means 78. The extruder 34, connecting, filtering and homogenizing means 78 and die head 38 may be identical to the extruder 32, connecting, filtering and homogenizing means 72 and die head 36 and, accordingly, only the latter system is shown and illustrated in FIGS. 8–11 and described in detail hereinafter.

The extruder 32 may comprise a commercially available extruder such as, for example, a 1-inch Model BF with a 24-inch length screw as manufactured by Sterling Extruder Corp., South Plainfield, New Jersey. The filtering section 74 may comprise a flange portion 80 for connection with the output end of the extruder 32. The filtering section 74 may comprise a plurality of hollow sintered metal filtering tubes 81 extending longitudinally therethrough and being connected with a header plate 82, which may also be of sintered metal or which may be of solid metal. The distal ends 83 of the filtering tubes 81 are closed, so that the flow of melted polymer is inward through the walls of the filtering tubes 81 to the hollow center portion thereof, and then longitudinally therethrough and through the header plate 82. The tubes 81, and the header plate 82, if of sintered construction, preferably comprise an average pore size range of from about 20 to about 60 microns.

A transition conduit section 84 is connected in general alignment with the filtering section 74, as by means of bolts 86 which also clamp the header plate 82 between the respective flanges 88 and 90 of the filtering section 74 and the transition conduit section 84. The transition conduit section 84 may have a conical passage therethrough in alignment with the filtering tubes 81 and the header plate 82 leading to a static blender element 92 fixedly mounted within the mixing section 76 connected thereto. The static blender element 92 may comprise a one inch diameter static blender with six alternately oppositely directed twist elements or helical blades, as manufactured by Kenics Corp., Danvers, Mass. and sold by them under the trademark Thermogenizer. The static blender element 92 assures that the resin is of uniform temperature and consistency and the mixing section 76 also directs the extruded resin therethrough into the passage of an angle head connector 94. Flanges 96 and 98 are provided on the mixing section 71 and it is bolted thereby to the transition section 84 and angle connector 94, as by means of bolts 102 and 104. The angle connector section 94 is provided with a flange 106 for connecting the die head 36 therewith, as by means of bolts 108. Heater means (not shown) are provided for maintaining the entire assembly at the desired temperature to maintain the polymer plasticized or melted therewithin.

Hence, the extruder 32 may be operated in a conventional horizontal position and the linear spinnerette or die head 36 extrudes the stream of filaments 40 generally vertically downwardly through ambient air to be pulled therefrom and drawn to textile denier by the draw roll set 44 within the draw section.

The die head 36 may comprise a manifold portion 110 having a manifold cavity 112 therein and a die plate 114 subjacent thereto and connected therewith, as by means of bolts 116. The die plate 114 may be provided with a generally rectangular polymer distributing groove 118 having generally tapered slides 120 and a generally flat floor 122 from which a plurality of monofilament forming orifices 124 extend downwardly through the die plate 114. To produce a 30 inch width stream of monofilaments 40 (it being recalled that one aspect of this invention is the delivery of the filaments to adjacent a formation location without disturbance of their linear array) and, accordingly, a 30 inch width web of cloth, the groove 118 may be approximately 30 inches in length and one-half inch in width. The groove 118 may be of approximately 2/10 inch depth to produce a die thickness through which the monofilament forming orifices 124 extend of about five-eighths of an inch tapering from an inlet opening 126 of approximately 0.130 inch diameter to a cylindrical tubular passageway of 0.040 inch diameter and about three-eighths inch length and thence to an exit opening 128 of 0.015 inch diameter and a land length for the outlet orifice portion 130 of 0.075 inch diameter.

Means such as a sintered metal final filter 131 may be disposed within the groove 118 for providing final filtration of the polymer immediately prior to extrusion through the orifices 124 and for providing a controlled back pressure to the extruder and pressure drop to the spinnerette orifices 124 to enhance the uniformity of polymer feed thereto. The filter 131 also may provide protection against transverse polymer flow between adjacent orifices which otherwise can produce instabilities in the polymer flow and random polymer starvation of the individual orifices.

Figure 10:
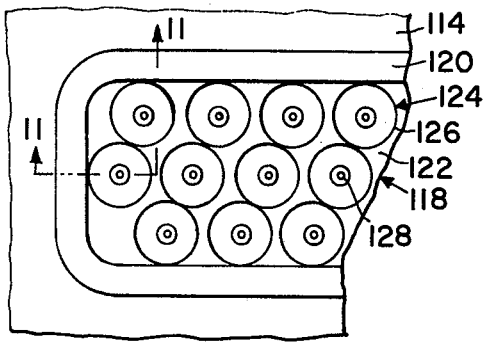
FIG. 10 is a further enlarged plan view of a portion of the die head of the preceding figures illustrating the die plate thereof.
Figure 11:
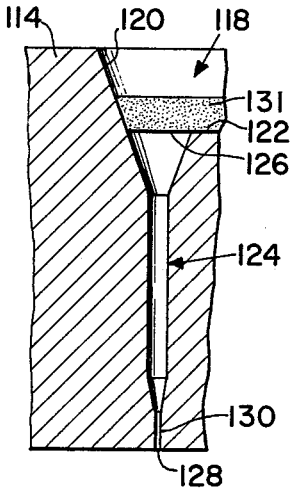
FIG. 11 is an elevational cross-section view of the die plate taken along line 11—11 of FIG. 10.

For producing such a 30 inch width stream of monofilaments, 600 such monofilament forming orifices 124 may be provided in the floor 122 of the die plate 114 in three parallel rows longitudinal the groove 118, with the individual orifices being staggered and angularly offset approximately 22° from the transverse axis of the groove 118 (the transverse axis being perpendicular the longitudinal axes of the three aforesaid rows) as shown and illustrated (particularly FIG. 10). In other words, the projection of the die exit openings 128 of the orifices 124 perpendicular the die length is a uniformly spaced apart row. This offset enables formation and feeding of a stream of monofilaments from the die 114 which becomes flat upon entrance to the draw roll set 44 aligned therewith.

Hence, viewing the die head 36 from the side (as viewed in FIGS. 8 and 11), each of the monofilament forming orifices 124 of the spinnerette 36 is laterally offset from each of its neighboring orifices and the drawn filaments pulled from the extruded monofilaments can be interleaved into a single plane to form a single line or row of filaments entering into the draw rolls of the draw roll set 44.

With continued reference to FIG. 6, now together with FIG. 12, the draw roll set 44 may comprise an inlet draw roll 132 and an exit draw roll 134 mounted for rotation relative a supporting frame assembly 136 on generally parallel vertically spaced apart horizontally extending axles 138 and 140, respectively. The inlet and exit draw rolls 132 and 134 are positioned (FIG. 6) generally beneath and to one side of the stream of monofilaments 40 with the axles 138 and 140 being generally parallel the longitudinal centerline of the linear die head or spinnerette 36. Hence, the stream of monofilaments 40 falling freely from the monofilament forming orifices 124 of the die head 36 will pass adjacent and to one side of the inlet and exit draw rolls 132 and 134 as indicated by the phantom line (FIG. 12). The inlet draw roll 132, or both of the draw rolls 132 and 134, may be rotated by drive means (hereinafter described) to provide a surface velocity greater than the rate of extrusion of the stream of monofilaments 40 from the spinnerette 36 to provide a mechanical drawdown and diameter reduction thereof to textile denier as the monofilaments leave the spinning orifices 124 and while still plastic when the stream of drawn filaments is wrapped around and into surface contact with the draw rolls 132 and 134.

To selectively provide such wrap of the stream of drawn filaments around the draw rolls 132 and 134, there may be provided an intermediate roll 142 having an axle 144 generally parallel and spaced apart from the axles 138 and 140. The intermediate roll 142 may also be driven by the drive means as described hereinafter.

In operating (filament drawing) configuration (shown in solid lines in the drawing), the intermediate roll 142 is disposed to draw the stream of filaments in a serpentine manner across the surfaces of the rolls 132, 134 and 142 passing in one direction around both of the inlet and exit draw rolls 132 and 134 and in the opposite direction around the intermediate roll 142. In this operating configuration, the intermediate roll 142 is disposed generally vertically between the inlet draw roll 132 and the exit draw roll 134, as shown in solid lines in FIG. 11. The stream of filaments therefore passes counterclockwise about the inlet draw roll 132, clockwise about the intermediate roll 142 and counterclockwise about the exit draw roll 134 (as viewed in FIGS. 6 and 12).

The inlet and exit draw rolls 132 and 134 may, for example, comprise aluminum or polished steel rolls of at least 30 inches length and having diameters, for example, of approximately 10 inches each. The intermediate roll 142 may also be an aluminum or a polished steel roll of a length of at least 30 inches and have a diameter, for example, of approximately 3 inches.

The intermediate roll 142 is preferably movable, as by being mounted on movable support arms 146 rockable about a support axis 148 generally parallel and spaced apart from the idler roll axle 144. The support axis 148 may be fixedly located relative the supporting frame 136, as by comprising stub axles supported on brackets (not shown).

Rigidly mounted with the support arms 146 for movement therewith about the axis 148, there may be provided a control arm 150 carrying locking means, such as a bolt 152 and a cooperating nut with the bolt 152 extending through an arcuate sector slot 154 in a member 156 fixedly mounted with the frame 136. Movement of the bolt 152 along the arcuate sector slot 154 therefore provides proportional movement of the intermediate roll 142 towards and away from the plane of the inlet draw roll axle 138 and the exit draw roll axle 140. Hence, by movement of the control member 150, the degree of wrap of the stream of filaments 40 around the inlet draw roll 132 and the exit draw roll 134 may be selected and controlled.

Further, the support means for the intermediate roll 142, including the support arm 146, control arm 150, locking bolt 152 and slot 154 are preferably constructed and arranged to enable the intermediate roll 142 to be moved fully through the plane of the free falling stream of filaments 40 between an operative position, shown in solid lines in FIG. 12 whereat the serpentine wrap of the stream filaments 40 around the rolls 132, 134 and 142 is achieved and an inoperative position, shown in phantom in FIG. 12, whereat the stream of filaments 40 is permitted to fall freely through the draw roll section 44, with the inlet and exit draw rolls 132 and 134 on one side thereof and the intermediate roll 142 on the other side thereof. In the operative position, (shown in solid lines in FIG. 12) the stream of filaments 40 may be wrapped, for example, about the inlet draw roll 132 approximately 85° and about the intermediate roll 142 and the exit draw roll 134 approximately 170°. The degree of wrap around the exit draw roll 134 is also effected by the positioning and operation of the air forwarding device or linear aspirator 52 mentioned hereinbefore (when used) and mounted, for example, with the frame 136 and described in more detail hereafter.

As hereinbefore pointed out, in the inoperative position of the intermediate roll 142, shown in phantom in FIG. 12, the free falling stream of filaments 40 pass between the intermediate roll 142 on one side and the inlet and exit draw rolls 132 and 134, respectively, on the other side, without effect. This enables the extruder to be operated without any drawing of the filaments when desired. The degree of draw may also be independently controlled.

Upon movement of the control arm 150 towards the operating position thereof, shown in solid lines in FIG. 12, however, intermediate roll 142 is moved across the plane of the free falling stream of monofilaments 40 to pick up the stream of monofilaments 40 and engage the stream of monofilaments 40 with the inlet and exit draw rolls 132 and 134 for drawdown of the stream of monofilaments 40 and diameter reduction of each of the filaments 22 thereof to textile denier as the intermediate roll 142 approaches the operating position thereof.

The rolls 132, 134 and 142 need be driven at a rate exceeding the extrusion rate of the die plate 114 in order to provide the mechanical drawdown of the filaments 22 and the resultant reduction in diameter thereof to textile denier when such reduction and drawdown is desired. Further, by operating the rolls 132 132, 134 and 142, and particularly the exit roll 134 at a high rate of speed (relative the rate of motion of the forming surface 54) the filaments of the filament stream 40 will be forwarded onto the forming surface 54 at such a high rate as to loop or bunch thereon (over-run of the filaments), providing random laydown and interintanglement thereof and well dispersed random fiber crossings. At lower draw speeds, less looping occurs and the filaments may, if as may be sometimes desired, be formed on the forming surface 54 without disturbing the alignment and distribution. At least one of the sets of filaments, however, must be dispersed to provide the necessary fiber crossings for bonding. The extrusion rate and the speed of the forming surface 54 also, of course, are factors in the extent of excursion, as is the filament denier and flexibility or stiffness, as well as the separation between the focii and the collection surface.

One or more of the rolls 132, 134 and 142 may be rotatably driven. Preferably, each of the rolls 132, 134 and 142 is positively driven. In accordance with one aspect of the present invention, each of the rolls 132, 134 and 142 is positively driven at the same velocity so that the drawing or attenuation of the filaments 22 generally uniformly occurs substantially immediately following the extrusion thereof and while the filaments are still in a melted, semi-melted or plastic state immediately following their exit from the extrusion die exit orifices 130.

In accordance with another aspect of the present invention, the exit draw roll 134 is positively rotated at a greater velocity than the inlet draw roll 132 so that additional drawing and attenuation of the filaments 22 is performed between the inlet draw roll 132 and the exit draw roll 134. Further, the inlet draw roll 132 may be heated, as by means of electrical cartridge heaters (not shown) so as to enable drawing or drafting of the filaments between the inlet draw roll 132 and the exit draw roll 134 to provide molecular orientation and strengthening thereto. The degree of such drafting, similar to conventional textile yarn or thread drafting, may be chosen in accordance with the desired end use. Hence, if, as is in accordance with one aspect of the present invention, only a single type of filament, such as polyester, is collected and bonded, a relatively strong, non-elastic bonded cloth may be produced by fully drafting the filaments between the inlet draw roll 132 and the exit draw roll 134.

If, on the other hand, as is in accordance with another aspect of the present invention, a mixed or dual filament type cloth is produced, as, for example, a cloth web containing both relatively elastomeric and relatively non-elastic filaments, then little or no drafting between the inlet draw roll 132 and the exit draw roll 134 may be desirable. Further, however, substantial drafting of the non-elastic filaments 22 may be utilized, in accordance with yet another aspect of the present invention, such that stretching of the completed bonded cloth in the stretch roll section 66 of the present apparatus completes the drafting of the non-elastic filament 22. The inlet stretch roll 190 (described hereinafter) may also be heated, as by means of electric cartridge heaters (now shown), or the like, to enable such drafting to be accomplished thereat.

With further reference to FIG. 12, independent drive means may be provided comprising, for example, separately controllable variable speed motors 133 and 135 for independently positively driving the inlet draw roll 132 and the exit draw roll 134, respectively, in accordance with another aspect of the present invention. The intermediate roll 142 may be positively connected with the drive means for the exit roll 134 so as to be driven at the same speed.

The inlet draw roll drive motor 133 may be connected with the inlet draw roll 132, as by means of a positive drive or timing belt 137 connected between a timing belt pulley 139 mounted with the output shaft of the motor 133 and a timing belt pulley 141 operatively connected with the inlet draw roll 132, as through the axle shaft 138 thereof. Hence, if the inlet draw roll drive motor 133 is operated generally counterclockwise (as viewed in FIG. 12) as indicated by the arrow, then the inlet draw roll 132 will also operate counterclockwise.

The exit draw roll drive motor 135 may be positively drivingly connected with the exit draw roll 134, as by means of a timing belt 145 extending between a timing belt pulley 143 drivingly connected with the exit draw roll drive motor 135 and a timing belt pulley 147 operatively connected with the exit draw roll 134, as by means of the axle shaft 140. Hence, upon counterclockwise rotation (as viewed in FIG. 12) of the exit draw roll motor 135 and its associated timing belt pulley 143, the exit draw roll 134 will also be positively driven in the clockwise direction.

The exit roll drive timing belt 145 may also be utilized to provide a positive driving connection for the intermediate draw roll 143, as by being passed around a tensioning idler pulley 151 and generally clockwise around a dual sheave drive timing belt pulley 153 rotatably freely carried on the axle 148 of the bracket 146 for the intermediate draw roll 142. In other words, the dual sheave timing belt pulley 153 is co-axial with the axis of movement of the intermediate pulley 142 between its operative and inoperative positions (hereinabove defined). The dual sheave timing belt pulley 153 is, as is clear from the drawing, (FIG. 12) accordingly driven generally clockwise, if the exit roll drive motor pulley 143 rotates counterclockwise, as shown.

A timing belt 155 may then be provided extending between the second timing belt pulley of the dual sheave timing belt pulley 153 and a timing belt pulley 157 drivingly connected with the intermediate draw roll 142, as by being mounted with its axle 144. The ratios of the timing belt pulleys 147, 153 and 157 may be selected so that the surface velocity of the intermediate drive roll 142 is appropriately related to the surface of velocity of the exit draw roll 134 and the inlet draw roll 132. In accordance with one aspect of the present invention, these pulley ratios are selected so that the intermediate draw roll 142 is operated at the same surface velocity as the exit draw roll 134 so that if the draw roll 134 is operated at a higher velocity than the inlet draw roll 132, mechanical drawing of the stream of filaments 40 will be produced during their passage from the inlet draw roll 132 to the intermediate draw roll 142 and, particularly if the inlet draw roll 132 is appropriately heated, molecular orientation of the filaments of the stream of filaments 40 will occur.

As heretofore pointed out, each of the spinnerette orifices 124 of the die 36 is substantially identical. Moreover, the manifold passage 112 and the final filter 131 (if utilized) substantially assure uniform extrusion of each of the filaments 22. Yet further, as also heretofore pointed out, the arrangement of the spinnerette orifices 124 within the die plate 144 is such as to enable interleaving of each of the filaments and the production of a planar equally spaced apart linear array or flat stream of filaments 40 across the longitudinal extent of the inlet draw roll 132 and maintenance of that flat stream of filaments around the intermediate roll 142 and exit draw roll 134. Hence, in accordance with the present invention each of the filaments 22 is substantially identically drawn and is of substantially identical denier and thermal and mechanical history whether attenuated only between the die or spinnerette 36 and the inlet draw roll 132 or if also attenuated within the draw roll set between, for example, the inlet draw roll 132 and the intermediate roll 142 or even, as may be desired, if not attenuated at all.

Draw roll cleaning means, such as doctor blades 159 may be provided for each of the draw rolls 132, 142, and 134, respectively.

The draw roll section 46 may be identical to the draw roll section 44 and similarly positioned beneath its associated linear spinnerette 38 and extruder 34 and in general horizontal alignment with the draw roll section 44.

As heretofore set forth, the extruded stream of monofilaments 40 is preferably in an equally spaced apart linear array and during drawing of the stream of monofilaments 40 to textile denier the parallel alignment and distribution is maintained. The stream of textile denier filaments 48 is drawn off of the exit draw roll 134 and delivered while substantially still in the equally spaced linear array to divergence points close to the collection surface, as by a linear air aspirator or air forwarding device 52. The air forwarding device or aspirator 52 may, for example, comprise a Linear Transvector supplied by the Vortec Corp., Cincinnati, Ohio which like the annular Transvector previously described comprises an air amplifier utilizing the Coanda Effect to produce a high volume curtain of air flowing therepast. The air curtain is generated by flow of high pressure air through a narrow slot 52' of 0.002 inches width which as a result of the Coanda Effect flows along a curved adjacent wall 52' to provide the aspirating effect.

The stream of drawn filaments 48 (from the draw roll section 44) may be mixed with the stream of drawn filaments 50 (from the draw roll section 46) and forwarded by a single aspirator 52 as a stream of mixed filaments 160 as indicated in solid lines in FIG. 12. Alternatively, and as shown in phantom in FIG. 12, the stream of filaments 50 from the draw roll section 46 may be separately forwarded by a second aspirator 52 mounted, for example, on a second support bracket 158 without departing from the present invention. Such air aspiration has been found effective when the distance between the divergence points and the draw section is not large or when the forming section is generally beneath the draw section and is then capable of stripping the filaments from the exit draw rolls and maintaining the stream alignment and distribution to the divergence points thereat and adjacent the forming surface 54. Such air forwarding may be especially desirable, in addition, to enable directed, rather than random formation of some or all of the forwarded filaments.

Yet further, however, and with reference now to FIGS. 13 and 14, positive filament delivering means, such as a delivering or forwarding belt 163 may be provided operatively associated with the draw roll set 44 for positively forwarding and delivering the stream of filaments 40 from the exit draw roll 134 to adjacent the forming surface 54 while positively maintaining the filaments within the stream generally uniformly distributed in the substantially equally spaced apart substantially linear array or other array determined by the die orifice configuration alone or as modified by any modulating means positioned beneath the die. Such belt is particularly useful in forwarding the streams of filaments horizontally over a substantial distance, as in the apparatus shown, illustrated and described. A similar belt may be applied to the draw roll set 46 or the same belt 163 may be fed through both draw roll sets 44 and 46.

The belt 163 may comprise a flexible, dimensionally stable material and in accordance with one aspect of the present invention is preferably porous and may comprise a woven plastic fabric belt, woven in accordance with Amneus U.S. Pat. No. 3,473,576 issued Oct. 21, 1969 of a dimensionally stable material, such a fully drawn polyester. Further, the supporting surface of the belt 163 may be flattened as by abrading the knuckle surfaces, such as by grinding or sanding thereof as taught by Friedberg et al U.S. Pat. No. 3,573,164 issued Mar. 30, 1971, to define a flattened surface 169, as illustrated in FIG. 14.

The belt 163 passes around the intermediate roll 142, beneath the exit draw roll 134 and around a plurality of idler rolls 165, appropriately mounted for rotation relative the apparatus frame and to a return roll 167 closely adjacent the forming surface 54 to define a short drop distance 175 for the filaments from the belt 163 to the fabric 54, as by being rotatably positioned above a gently upwardly inclined or directed portion 171 thereof immediately adjacent the bonding nip 62, above the vacuum box 56 which is as illustrated in FIG. 13 at that location. The portion 171 may be inclined, for example, about 15° to the horizontal.

The short drop distance 175 from the front of the return roll 167 defines the unsupported span during which each filament loops and moves with generally symmetric excursions or deviations from its lateral position on the belt 163, which lateral position defines a focus therefore and whose projection on the fabric 54 defines a mean position or line in the web 60 for that filament. The mean position, due to the precise control of each filament to its focus, release or divergence point from the belt 163, is also precisely controlled in the web and the short span 175 restricts the deviation or excursions of each filament from its mean position. Hence, highly controlled formation of the web 60 may be achieved. In the embodiment of FIGS. 1–6, the aspirator 52, in positively drawing the filaments from the exit draw roll 134 defines the focus points from which each filament thereafter diverges. Preferably, of course, a sufficient vacuum is pulled through the vacuum box 56 to maintain a positive pressure gradient or pull on the filaments until laydown.

It will be recalled that the drive system for the exit draw roll 134 and the intermediate roll 142 is preferably constructed and arranged to drive both rolls at the same surface velocity, and in opposite directions of rotation to provide a nip therebetween moving downwardly, as indicated by the arrows in FIG. 13. Hence, the belt 163 is driven therearound also at the same surface velocity and in the same downward direction.

The belt 163 wraps the intermediate roll 142 approximately 180° and then wraps partially around the exit draw roll 134, for example, about 105°, as shown to form a filament drawing nip therewith. The belt 163 carries the stream of filaments from the exit draw roll 134 to the return roll 167, delivering the stream of filaments positively thereto while maintaining and without disturbing the stream alignment and distribution. Hence, as is in accordance with one aspect of the present invention, the die extrudes the stream of filaments as a substantially equally spaced apart substantially linear array and the belt 163 carries the stream while maintaining the substantially equally spaced apart substantially linear array to focii closely adjacent the formation point or location, the focii being defined by the return roll 167 closely superjacent the forming surface 54 and the subjacent vacuum box 56.

At the forming location, as the belt 163 makes the return bend around the return roll 167, the stream of filaments 40 tumble off, looping and bunching onto the slower moving forming surface 54. Separation of the stream of filaments 40 from the carrying belt 163 is further enhanced by the vacuum box 56 and the flow of air thereto through the porous forming surface 54. To further aid in separation, an air knife or linear air manifold 173 may be provided adjacent the return roll 167 and between the bights of the belt 163 formed therearound and directed downwardly to blow a stream of air downwardly through the belt 163 immediately as the belt leaves the return roll 167. Yet further, the air curtain aspirator 52 may be positioned immediately forward of the return roller 167, directing a curtain of air downwardly past the leading edge of the belt 163 as it turns around the return roll 167, and directed into the vacuum box 56, further providing positive separation of the filaments from the belt 163 at the filament divergence points or focii of their excursions from mean positions thereof at the front of the return roll 167.

After leaving the return roll 167, the belt 163 is directed back, as by movement over a further idler roll 165 towards the intermediate draw roll 142. The belt 163 is, as is believed readily apparent, preferably continuous. A guide roll 177, appropriately controlled by automatic means (not shown) responsive to sideways movement of the belt 163 may be provided for automatically compensating for sideways movement of the belt 163 and maintaining the belt 163 tracking properly. Such guide rolls, and their associated control means are well known and are conventionally used, for example, for guiding the wires and fabrics of a paper machine.

The stream of filaments 48 while supported on the belt 163 is maintained in a planar stream without disturbance of the alignment and distribution of the filaments during forwarding thereby from the draw roll set 44 to divergence points or focii adjacent the forming surface 54.

Figure 16:
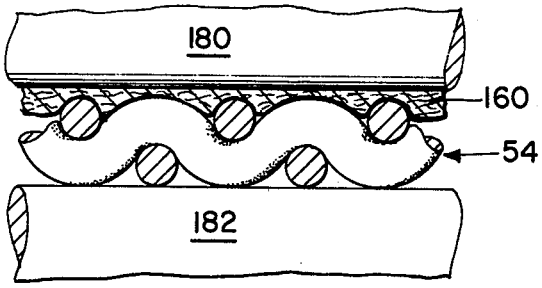
FIG. 16 is an enlarged cross-section partial view through the bonding nip of the forming section taken along line 16—16 of FIG. 15.
Figure 15:
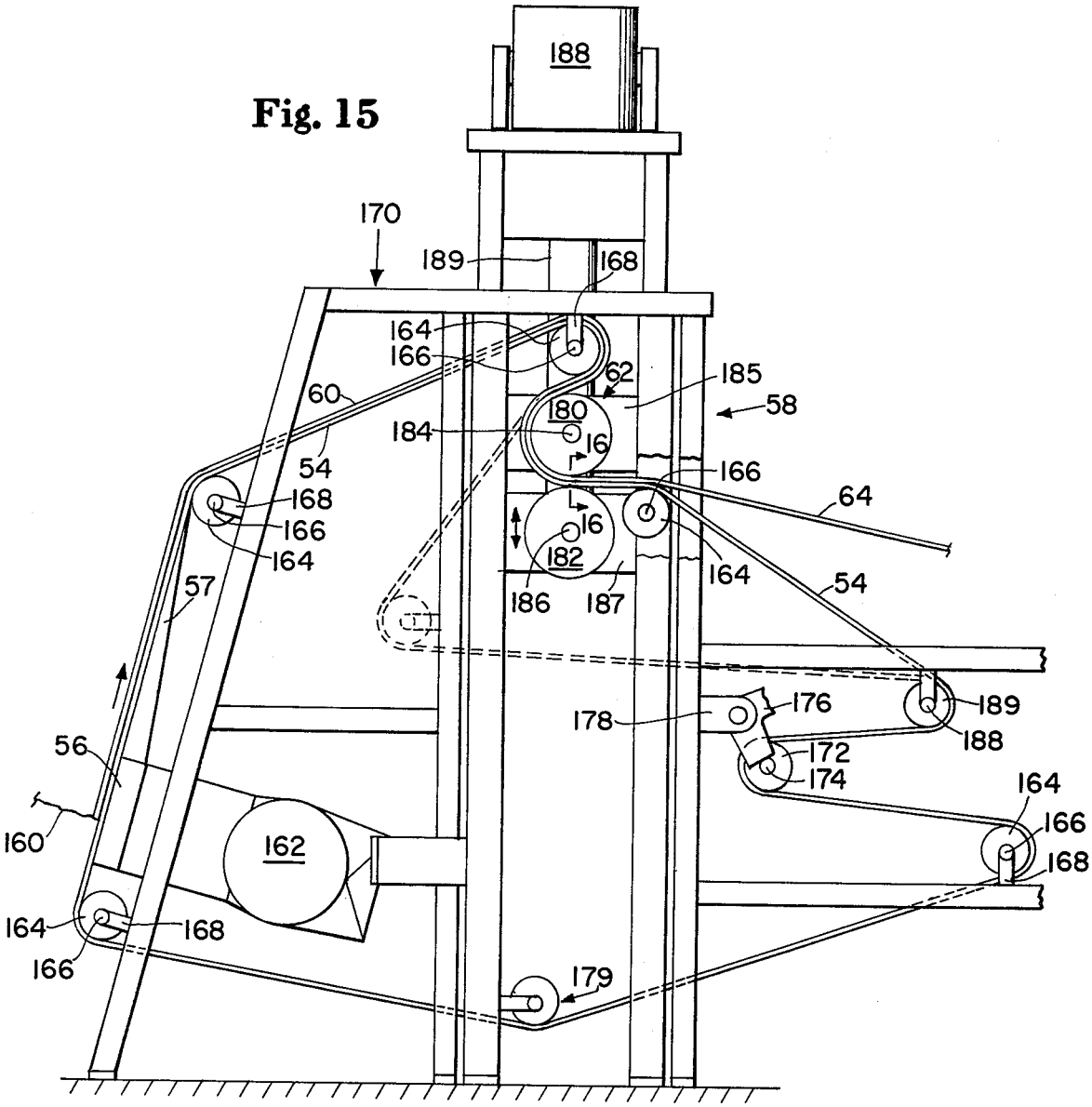
FIG. 15 is an enlarged side elevation partial illustration similar to FIG. 12 of the forming section of the apparatus of FIG. 6, showing the details thereof.

With renewed reference again to FIG. 6, together now with FIGS. 15 and 16, the forming section 58 may comprise a porous and flexible forming surface 54 supported for movement, preferably upwardly, over the surface of a preferably slightly tilted vacuum box 56 to enable formation of a random laid continuous unbonded web 60 from the stream of mixed filaments 160 forwarded thereto by the forwarding means, such as the aspirator 52 (FIGS. 6 and 12) or delivering belt 163 (FIG. 13). The rapid forwarding of the stream of filaments 160 together with the turbulence of the air stream, when present, produce the random looping thereof. The surface 54 then conveys the unbonded web 60 through a heated bonding nip 62 for bonding into a coherent cloth web 60, either spot bonded or continuously bonded.

The forming surface 54 may, in accordance with one aspect of this invention, comprise a continuous porous woven fabric woven of wire or other materials such as, for example, drafted polyester monofilaments in accordance with the teachings of Amneus U.S. Pat. No. 3,473,576, issued Oct. 21, 1969, to produce closely spaced apart rounded knuckles of equal heights. While various weave patterns and mesh sizes can be utilized, including plain weaves, twill weaves (including semi-twill, full-twill, and variations thereof), etc., it has been found that for the production of a cloth having an appearance, hand and finish suitable for the production of lady's panties, or the like, that a semi-twill forming fabric fabricated 36 warp and 30 woof threads of 12 mil diameter PET polyester monofilament and produced in accordance with the aforesaid Amneus U.S. Pat. No. 3,473,576 is especially suitable.

The vacuum box 56 may be driven by means of a vacuum blower 162 connected therewith through appropriate baffling and the like, and may further comprise an extension or secondary section 57 providing reduced support for the unbonded web 60 during its generally vertical movement and to reduce any tendency of the air entering the vacuum box 56 from forming a vortex at the forward edge thereof.

The forming surface or fabric 54, as hereinbefore pointed out, is preferably a continuous fabric belt having a width substantially equal to or slightly larger than the width of the cloth to be produced and, in the instant apparatus, may be of a width of approximately 34 inches. The forming surface 54 may be supported for continuous movement generally upwardly across the vacuum box 56 and past the bonding nip 62 by means of a plurality of supporting rollers 164 rotatably mounted upon axles 166 carried on support brackets 168. The support brackets 168 may in turn be carried by a fixed frame assembly 170. There may also be provided a movable tensioning idler roll 172 rotatably carried on an axle 174. The axle 174 may be carried, in turn, by a movable bracket 176 pivotally mounted with the frame assembly 170, as by means of a bracket 178. The idler roll bracket 176 may be biased to provide tensioning of the forming surface 54 by means, such as a spring, air spring, air cylinder, or the like (not shown). A guide roll 179, having automatic control means (not shown) and similar to the guide roll 177 heretofore described may also be provided to maintain the forming surface 54 tracking properly. The forming fabric 54 should be at least as wide as the stream of filaments 44 plus the maximum excursions of the edgemost filaments from their mean or focii locations.

The bonding nip 62 may comprise an upper roll 180 and a lower roll 182 mounted on axles 184 and 186, respectively, together with means, such as a pressure cylinder structure 188 for moving one of the rolls 180 and 182, as through linkage 183 to apply bonding pressure or loading to the rolls 180 and 182. The rolls 180 and 182 may both be hard, such as polished steel, or one of the rolls, such as lower roll 182 (which contacts the fabric 54) may be covered with rubber or other suitable elastomer and may be, for example, approximately 8 inches in diameter. The upper roll 180 may, for example, have its axle 184 carried on fixed brackets 185 and the lower roll 182 may have its axle 186 carried on movable brackets 187 mounted with the linkage 183 to the pressure cylinder 188 to provide adjustable nip pressure or loading. Further, one or both of the nip rolls 180 and 182 may be heated, as by electrical resistance heaters embedded therein, for example (not shown). Preferably, only the upper roll 180 is heated and comprises a metal heat transfer surface and the forming surface 54 with the unbonded web 60 carried thereon together pass through the bonding nip 62 between the heated roll 180 and the unheated roll 182, as shown in solid lines in FIG. 15 and in more detail in FIG. 16. At least one of the rolls 180 and 182, for example, the heated roll 180 is driven, although under certain conditions it may be advisable to drive both the upper roll 180 and the lower roll 182 or the lower roll 182 alone, by drive means, not shown, to have a surface velocity equal to the surface velocity of the forming wire or screen 54. The forming surface 54 is also preferably separately driven by a drive roll 189 carried on an axle 186 by drive means, not shown. The drive roll 189 is preferably disposed on the upstream side of the tensioning idler roll 172 so as to provide uniform pulling of the forming surface 54 from the vacuum box 56 through the bonding nip 62. Subsequent to passage through the bonding nip 62, the bonded coherent cloth web 64 is separated from the forming surface 54 for subsequent incremental stretching in the incremental stretch section 66.

A release agent, for example a release agent of the fluorochemical type, such as DuPont Vydex or a release agent of the quartenary surfactant type, such as dialkyl dimethyl ammonium chloride may be applied, as required, on the pressure roll 180 and the forming surface 54 to avoid unwanted adherence of the web to these parts during bonding.

By constructing the forming surface 54 of woven porous fabric with generally equal knuckle heights, as hereinbefore stated and by passage of the forming fabric 54 through the bonding nip 62 with the unbonded web 60 carried thereon, the knuckles of the forming fabric 54 emboss the unbonded web of cloth 60 (FIG. 16) while providing spot bonding thereof to increase the suppleness and flexibility of the bonded cloth sheet 64 and to enable provision of the appearance and feel of conventionally knit or woven fabrics thereto. Further, by the preferred construction set forth above, the upper roll 180 is heated and contacts the web 60, is rigidly mounted in position and is driven. The lower roll 182, on the other hand, is unheated, contacts the forming fabric 54, is undriven, and is movable by the pressure cylinder 188.

Furthermore, by passing the forming fabric 54 through the bonding nip 62 with the web 60 carried thereon, the precise formation of the unbonded web 60 can be maintained until the bonding occurs in the nip 62 and distortion thereof, as might occur if the web 60 is separated from the fabric 54 prior to passage of the web 60 through the nip 62, is eliminated.

Alternatively, and still in accordance with the present invention, the unbonded web 60 may be separated from the forming surface 54 prior to passage of the web through the bonding nip 62 so that the unbonded web 60 passes through the bonding nip 62 without support to enable the uniformly applied compression pressure to form the bonded sheet of material 64. In this embodiment of the present invention, the forming surface 54 bypasses the bonding nip 62 in its passage to the drive roll 188, as shown in phantom lines in FIG. 15. The upper roll 180 and/or the lower roll 182 may be smooth, as shown, or may be embossed to provide a desired bond pattern to the bonded cloth web 64 independent or substantially independent of the pattern of the forming surface 54 or in combination therewith.

Further, it is also within the purview of the present invention to provide heating of one of the rolls 180 and 182 by a flow of hot air therethrough and to provide a porous surface thereon to enable such hot air to flow readily outwardly thereof through the web prior to and during bonding thereof for preheating thereof or to provide bonding heat thereto. Means may also be provided to enable application to the forming surface 54 of a release agent or of a bonding agent such as adhesive for transfer to the unbonded web 60, such applicator being positioned, for example, upstream of the vacuum box 56. Yet further, means may be provided for applying such adhesive or bonding agent to the unbonded web 60 between the vacuum box 56 and the bonding nip 62.

Yet further, small quantities of water, or the like, may be applied to the unbonded web 60, as by a roller or a mist spray device, or the like, (not shown) to generate steam within the web during contact with the heated roll 180 and during passage of the web through the bonding nip 62 to aid in heat transfer to the interior of the web and to the bond points thereof.

Hence, in accordance with the present invention, two general types of bonding configurations may be utilized without departing from the scope thereof. Firstly, and as diagrammatically shown in FIGS. 1–3, there may be autogenous bonding of substantially all of the fiber crossings 26. Such bonding of substantially all of the fiber crossings may be accomplished by providing generally uniform heat and pressure, as by passing the unbonded web through a generally uniform pressure bonding nip or by providing generally uniform heating of the web immediately prior to and during the bonding process, as by blowing heated air therethrough, or by a combination thereof. Such cloth may be fabricated with the apparatus of the present invention by separating the unbonded web 60 from the forming surface 54 prior to passage of the web through the bonding nip 62 so that the web passes unsupported therethrough, as indicated in phantom lines (FIG. 15) or by using a generally smooth forming fabric as, for example, a sanded or ground belt like the belt 163, and passing both the smooth fabric and the unbonded web through (FIG. 15). Both of the bonding nip rolls 180 and 182 may be heated and/or made porous and a supply of heated air or steam passed through the web to provide primary or additional heating thereof. Moisture may be added to the unbonded web 60 and steam generated therein during bonding. Yet further, the bonding need not be necessarily or totally autogenous and additional bonding material or adhesives may be utilized (which would preferably be selected to generally tend to collect at the fiber crossings).

Alternatively, the bonding may be by primarily patterned spot bonding as in the cloth as shown in the photomicrographs, FIGS. 4 and 5, wherein the spot bonds are designated by the reference character 26. Such cloth may be produced by utilizing an embossed roll in the bonding nip 62, or in accordance with one aspect of the present invention by constructing the forming surface of a porous woven fabric having generally uniform height, preferably although not necessarily rounded, knuckles and maintaining the forming fabric 54 together with the unbonded web 60 supported thereon, as formed, and passing both through the bonding nip 62 as shown in solid lines in FIGS. 15 and 16 and utilizing the knuckle pattern of the forming fabric 54 to define the spot bonds 26. Some autogenous bonding of the fiber crossings not spot bonded by the pattern of high knuckle pressure produced by the knuckles may also, of course, occur.

EXAMPLE III

The apparatus of FIG. 13 in conjunction with the bonding and winding sections of FIGS. 6, 8, 9, 10, 11 and 15 was used to form a roll of uniform well bonded random lay web of polypropylene filaments when operated at the conditions herein set forth.

Extruder 34, having a 1¾ inch diameter 24:1 L:D ratio screw with a compression ratio of 4:1 formed by a continuously tapering root was operated at 62 RPM screw speed to extrude 600 filaments of the polypropylene of Example II at a rate of 100 grams per minute against a filter pressure drop of 2500 psig and a die pressure drop of about 80 psig.

The feed, transition, and metering sections of the extruder were set at 390° F, 430° F and 480° F respectively. The filtering, mixing, and three die zones were all set at 500° F.

Primary filtering was accomplished by a screen pack and secondary filtering by a 20 micron porosity unit described as item 74. The 30 inch die and manifold described in FIGS. 8, 9 and 10 was operated as described with the exception that a perforated metal sheet was inserted in the manner of a gasket between the die 114 and the manifold 36. The metal sheet, formed of nickel by Perforated Products, Inc., Boston, Mass., was 0.0059 inch thick and contained closely spaced uniformly distributed divergent walled conical holes with entries 0.010 inch in diameter to provide an open area of 14.5%. This device aided in providing good filament extrusion uniformity.

The draw system of FIG. 13 was operated with the belt of the Friedburg et al patent at a speed of 380 FPM to carry the filaments in spaced array to the curtain transvector 52 which entrained the filaments as they passed around the roll 167 and deposited them in a random loop pattern against a two stage vacuum box 56.

In addition to the curtain transvector 52 which had its downstream wall extended along the face of the retention roll 167 by a curved plate and which was operated at 30 psi, a second air film was formed and directed into the space between the roll 164 and the return path of the draw belt by the manifold 173 to prevent filaments from following the air film carried by the belt 163 on its return path.

The 30×36 mesh embossing belt 54 was carried over the vacuum box 56 at 25 FPM. The first vacuum box stage 56 beneath the transvector was operated at 3 inch water negative pressure. The second stage 57 was operated at about 0.5 inch water negative pressure.

Belts 163 and 54 were contacted by dampened (but not saturated) felts shortly before filament contact to reduce static charge to acceptable levels.

The web on the 30×36 mesh carrier was then passed through the bonding nip defined by rolls 180 and 182. Complete bonding was obtained at an embossing fabric tension of 10 pli, an embossing pressure of 170 pli, a pre-wrap angle of about 30° around roll 180, and a roll surface temperature for roll 180 of 285° F.

The autogenously bonded web thus formed of 12 denier polypropylene filaments had a basis weight of 22.4 grams per square meter, a machine direction tensile strength of 2.3 lbs per inch and a cross direction tensile strength of 1.4 lbs per inch at elongations at rupture of 50 and 40% respectively. This relatively porous open material has application in uses where scrim products may be used.

Figure 18:
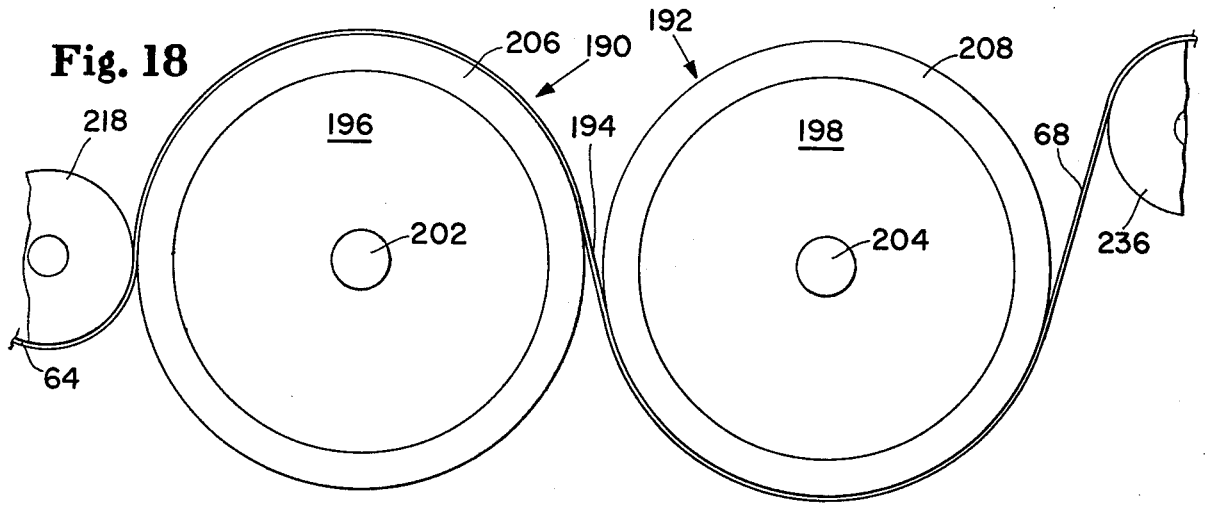
FIG. 18 is an enlarged cross section illustration of a portion of the incremental stretching section shown in FIG. 17, showing the details of the stretch rolls and illustrating how incremental stretching is achieved in accordance herewith.

Referring now once again to FIG. 6 together now with FIGS. 17 and 18, it will be recalled that in accordance with one aspect of the present invention the bonded cloth 64, comprising both relatively elastomeric and elongatable but relatively non-elastic filaments bonded at at least some of their fiber crossings, may in accordance with one aspect of this invention be mechanically worked, as by being stretched subsequent to bonding and relaxed to develop the low modulus of elasticity and suppleness, hand and drape characteristics associated with finished elastic cloth of the present invention. It will also be recalled that as has also been heretofore pointed out, such stretching can be in a single direction to provide a one-way stretch fabric or may be performed in a plurality of directions, such as two generally mutually perpendicular directions to produce a two-way stretch fabric, generally as schematically illustrated in FIGS. 2 and 3.

For many purposes, however, a one-way stretch material is either desirable (because, for example, of its resistance to stretch in the cross direction) or sufficient (such as, for example, where give in only a single direction is needed). The toughness and resistance to tearing in the direction transverse thereto is not, of course, affected or lost. The required stretching may be accomplished in accordance with the present invention by diverse means. For example, and as was described in detail in connection with Example I above, individual sheets of the cloth may be clamped in linear edge clamps and the edge clamps pulled away from one another to stretch the material extending therebetween. Such stretching can be either unidirectional (as in Example I) or bi-directional (simultaneously or sequentially). Tenter frames may be used, as may angularly oriented caterpillar draw clamps, vacuum or male-female mold technique or the like. Preferably, however, in order to produce uniform characteristics, incremental stretching of the bonded coherent cloth material 64 is utilized.

Incremental stretching is defined as the process of stretching the cloth by means which supports the cloth at plural closely spaced apart locations during elongation of the fibers therebetween and thereby restricting the fiber elongation to specifically controlled increments of elongation, which increments are defined by the spacing between the support locations. Hence, by incremental stretching, the fibers may be specifically elongated with the percent elongation of each fiber lying in the stretch direction being uniform throughout the length of the cloth in the stretch direction.

Further, by incremental stretching not only is the elongation of the individual fibers made generally uniform but, in addition, the positive support of the cloth adjacent each incremental stretch distance substantially prevents movement of individual fibers within the cloth relative one another during stretch and particularly relative movement therebetween in the cross direction, i.e., in the direction perpendicular the direction of stretch. Incremental stretching may be achieved in a number of ways, each of which provide support for the cloth fibers with a very short span of unsupported fiber extending between the support locations, which are then moved apart to elongate the short span of unsupported fiber. For example, incremental stretching generally uniformly in plural directions may be achieved by positioning a sheet of cloth between thick elastomeric blocks of soft rubber, or the like, having a high coefficient of friction against the cloth and uniformly compressing the blocks with the cloth therebetween in the direction perpendicular the plane of the cloth, as in a platen press, to expand the blocks and thereby the cloth clamped therebetween generally uniformly perpendicular the pressure direction, i.e., parallel the plane of the cloth as detailed in Example II above. Other and further means will be apparent to those skilled in the art for providing incremental stretching and to uniformly stretch only very short spans, as by embossing rolls, corrugated rolls, highly compressed soft rubber rolls, or the like.

Further, however, and in accordance with another aspect of the present invention, incremental stretching may be readily accomplished on a continuous and controllable basis, particularly in the machine direction by passing the bonded cloth 64 sequentially over closely spaced differentially rotating stretch rolls 190 and 192 (see particularly FIG. 18) to define a very short unsupported span 194 therebetween and with the roll 192 being driven at a greater velocity than the roll 190 by differential drive means, such as is hereinafter detailed. The unsupported span is preferably as small as possible and, therefore, the gap between the rolls 190 and 192 may be on the order of approximately 2–3 times the thickness of the cloth web 64. Each of the rolls 190 and 192 may be provided with a surface having a high coefficient of friction against the unstretched but bonded coherent cloth 64 and against the stretched cloth 68 as by comprising, for example, steel cores 196 and 198, respectively, carried on parallel spaced apart axles 202 and 204, respectively, covered, for example, with elastomeric, rubber, or rubber-like cover layers 206 and 208, respectively. The rolls 190 and 192 may suitably by of diameters of approximately 4 inches and the covering layers 206 and 208 may be of urethane elastomer having a Shore Durometer (A Scale) hardness of approximately 50–60.

The bonded coherent cloth 64 may be fed into the incremental stretch roll section 66 by being passed over an input idler support roll 210 rotatably carried on a bracket 212. The bracket 212 may, in turn, be mounted with a supporting frame assembly 214. The idler roll 210 preferably rotates about an axis generally parallel and spaced apart from the axles 202 and 204 of the stretch rolls 190 and 192, respectively.

The axle 202 of the stretch roll 190 may be carried on a bracket 216 mounted, in turn, on the frame assembly 214 so as to be fixedly positioned relative thereto.

A movable wrap idler roll 218 may be provided positioned between the input idler support roll 210 and the stretch roll 190 to provide maximum frictional contact of the bonded coherent cloth 64 on the elastomeric layer 206 of the stretch roll 190 by directing the coherent bonded cloth 64 for maximum wrapping thereabout. As shown, the movable idler wrap roll 218 enables the provision of approximately 180° of wrap of the bonded coherent cloth 64 around the stretch roll 190 when idler wrap roll 218 is in its operative position, shown in solid lines in FIG. 17).

The idler wrap roll 218 may be carried on an axle 220 in turn carried on movable support brackets 222. The brackets 222 may be movable along a generally arcuate slot 224 provided in sector plates 226 mounted, in turn, by mounting means 228 on the frame apparatus 214. The arcuate slots 224 enable movement of the brackets 222 about a pivotal axle 230 while maintaining the axle 220 generally radially outwardly thereof. The support brackets 222 and idler wrap roll 218 carried thereby may, therefore, be moved generally through 90° between the operative position shown in solid lines (in FIG. 17) whereat the idler wrap roll 218 provides the maximum wrap of the bonded coherent cloth 64 around the stretch roll 190 and a threading position, shown in phantom lines (in FIG. 17) whereat the idler wrap roller 218 is substantially spaced apart from and vertically above the stretch roll 190 to enable the bonded coherent cloth 64 to be readily and easily threaded therebetween, as also indicated in phantom lines (FIG. 17).

The stretch roll 192 may also be movably mounted, as by its axle 204 being carried by pivotal support brackets 232. The brackets 232 may, for example, be mounted on a pivotal axle 234 so that the stretch roll 192 may be moved through a generally arcuate path between its operative position closely adjacent the stretch roll 190, shown in solid lines in FIG. 17 and a threading position thereof, shown in phantom lines in FIG. 17. In its threading position (shown in phantom lines), the stretch roll 192 is spaced apart from the stretch roll 190 providing a substantial gap therebetween through which the cloth may be readily threaded, as also indicated by the phantom lines (FIG. 17).

In the operative position of the stretch roll 192 (shown in solid lines in FIG. 17 and as shown in FIG. 18) the stretch roll 192 is, as hereinbefore pointed out, closely adjacent the stretch roll 190 with the cloth 64, 68, being wrapped oppositely therearound in an S-wrap having the short unsupported span portion 194 therebetween. Hence, as viewed in FIGS. 17 and 18, the bonded coherent unstretched cloth 64 passes generally clockwise upwardly around the stretch roll 190 while the stretched cloth 68 is wrapped generally counterclockwise beneath the stretch roll 192, with the stretching occurring substantially entirely within the short unsupported span portion 194. The span portion 194 is preferably as short as possible to provide essentially incremental stretch to the cloth 64. In order to provide maximum wrapping of the stretched cloth 68 around the stretch roll 192 for maximum surface contact and friction therebetween and thereby enable stretching substantially only within the span portion 194, an output idler wrap roll 236 may be provided. The output idler wrap roll 236 may be rotatably carried, for example, on an axle 238 carried, in turn, by mounting brackets 240 fixedly mounted on the support frame assembly 214. The output idler wrap roll 236 may be disposed to provide substantially 180° of wrap of the stretched cloth 68 around the stretch roll 192 when the stretch roll 192 is in its operative position.

Means may also be provided for moving the stretch roll 192 (and the associated bracked 232) between its operative and inoperative position (shown in solid lines and phantom lines, respectively, in FIG. 17) and such means may comprise, for example, a pneumatic linear motor 242 having its cylinder 244, for example, pivotally mounted on a bracket 246 mounted with the frame assembly 214 and its piston rod 248 pivotally connected with a control arm 249 fixedly connected, as by the axle 234, with the stretch roll support brackets 232 so that extension of the motor 242 pivots the control arm 249, axle 234 and brackets 232 to move the stretch roll 192 as shown and hereinbefore described.

It will be understood that the unstretched bonded coherent cloth 64, through high frictional contact with the surface of the stretch roll 190 moves at the surface velocity thereof while the stretched cloth 68, through high frictional contact with the surface of the stretch roll 192 moves at the surface velocity thereof to provide for the incremental stretching in the unsupported span section 194.

Differential drive means are also provided in accordance herewith for rotating the stretch roll 192 faster than the stretch roll 190 while positively driving both rolls 190 and 192 at the desired rates. With further reference to FIG. 17, such differential drive means may comprise a pair of Positive Infinitely Variable (hereinafter PIV) transmissions 252 and 254, the input 256 of the first PIV transmission 252 being driven from the machine drive, as by a timing belt 257. The output shaft of the first PIV transmission 252 may be provided with a dual sheave timing belt pulley 258 which is connected, by means of, for example, timing belts 260 and 262 to drive both the stretch roll 190 and an input timing belt pulley 264 of the second PIV transmission 254. The output timing belt pulley 266 of the second PIV transmission 254 in turn drives the stretch roll 192, as by means of, for example, a timing belt 268 connected with a dual sheave timing belt pulley 270 driven counterclockwise by passage of the timing belt 268 counterclockwise therepast through movement of the timing belt 268 about a pair of idler timing belt pulleys 271. This provides wrap of the timing belt 268 around a portion of the periphery of the pulley 270, as shown. The timing belt pulley 270 is rotatably carried on the axle 234 to drive, for example, a second timing belt 272 for, in turn, driving the stretch roll 192 counterclockwise (as seen in FIG. 17).

Accordingly, the second PIV transmission 254 controls the stretch ratio which ratio, once set, is independent of the line speed. The line speed is set by the first PIV transmission 252. The second PIV transmission 254, being driven from the output of the first PIV transmission 252 with its output, in turn, connected with the stretch roll 292 accordingly defines means for variably setting the stretch roll ratio independent of the over-all production or line speed.

It has been heretofore pointed out that the dual filament cloth forming one aspect of the present invention may be fabricated by mixing the relatively elastomeric and the elongatable but relatively non-elastomeric filaments prior to deposition and formation of the unbonded coherent web. It has also been heretofore pointed out that the elongatable but relatively non-elastic filaments and the relatively elastomeric filaments may be deposited in discrete or generally discrete layers and subsequently laminated or bonded. It should also be appreciated that elastomeric filaments (and cloth structures or laminae made entirely or substantially entirely therefrom) generally exhibit high surface friction and a "sticky" or "tacky" feel. On the other hand, cloth structures or laminas made entirely or substantially entirely of non-elastic filaments tend to be slicker and less "sticky" or "tacky". Bearing in mind the foregoing, it will be appreciated that the continuous production of a layered bonded cloth having both non-elastic and elastomeric continuous filaments may also be produced generally with apparatus in accordance with the present invention. Further, in accordance with a further aspect of the present invention, a single layer of substantially entirely relatively elastomeric continuous filaments may be bonded between a pair of facing layers of substantially entirely elongatable but relatively non-elastic filaments, such as is described hereinabove in connection with Example I may be produced in accordance herewith.

Figure 19:
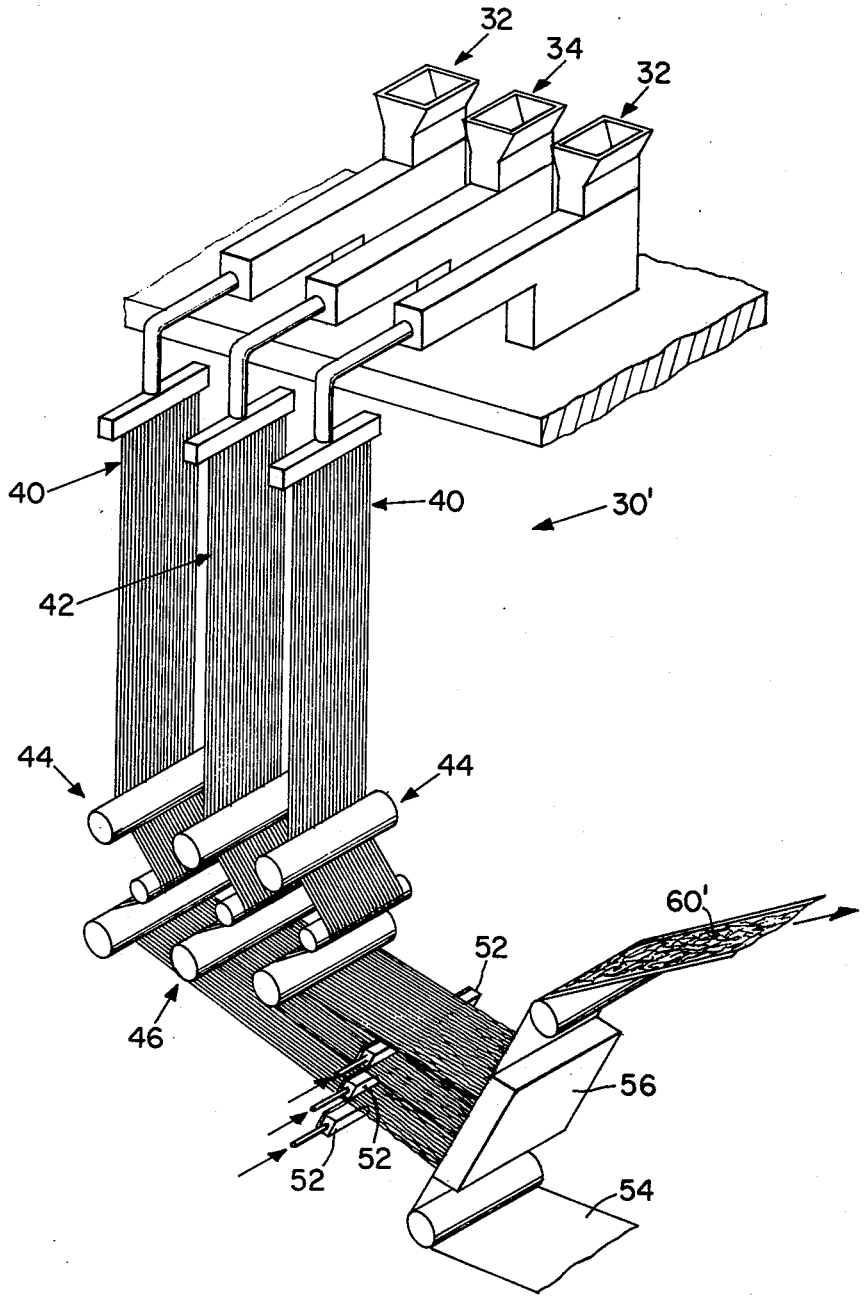
FIG. 19 is a diagrammatic perspective illustration of the filament extruding, drawing, forwarding and initial forming sections of another apparatus similar to the apparatus of FIG. 6 for producing three layer, laminated, continuous filament bonded cloth in accordance herewith.

Accordingly, and with reference now to FIG. 19, there is shown and illustrated apparatus generally designated by the reference character 30' substantially similar to the apparatus of FIG. 6 but for simultaneously extruding, drawing or drafting and forwarding three distinct streams of filaments to form a three layered unbonded web for bonding and stretching, as by use of the remainder of the apparatus 30 shown in FIG. 6. The apparatus 30' may, more particularly, produce a three layered cloth structure having a relatively elastomeric filament layer laminated between two relatively non-elastic filament layers.

In FIG. 19, and in the following description, the apparatus 30' is identical to the apparatus 30 except where specific differences are pointed out. Accordingly, like reference characters are utilized in FIG. 19 as in FIG. 6. Hence, an extruder 34 for the elastomeric polymer is provided disposed between a pair of extruders 32 for the non-elastic polymer. The extruder 34 separately extrudes a stream of elastomeric filaments 42 between a pair of streams of non-elastic filaments 40 separately extruded by the extruders 32. Separate drawing or drafting of the stream of filaments is provided by a single set of draw rolls 46 for the elastomeric filaments provided positioned between a pair of sets 44 of draw rolls for the non-elastic filaments. Three separate aspirators 52 or other forwarding devices are provided for successively depositing a non-elastic layer, an elastomeric layer and a second non-elastic layer over the vacuum box 56 onto the forming wire or screen 54 to produce a three layered unbonded web 65 for subsequent bonding in the bonding nip 62, stretching in the stretch roll section 66 and windup on the take-up roll 70. Belt forwarding may also be used.

While the invention has been described, disclosed, illustrated and shown in terms of certain embodiments or modifications herein described, disclosed, illustrated or shown, such other embodiments or modifications as may be suggested to those having the benefit of the teachings herein being intended to be reserved especially as they fall within the scope and breadth of the claims here appended.

What is claimed is:

1. Cloth comprised of at least two types of organic polymer fibers, at least one of which is elastomeric, at least one of which is elongatable but non-elastic, at least one of which is dispersed to provide frequent random fiber crossings at least some of which are bonded at a bond strength which is sufficient to enable the non-elastic fibers to be stretched between said bonds without, in the majority of instances, breaking those bonds, said bonded crossings including at least some wherein said elongatable fibers are heat bonded to each other, at least some wherein said elongatable fibers are heat bonded to said elastic fibers, and at least some wherein said elastic fibers are heat bonded together.

2. Cloth defined in claim 1 wherein each of said relatively non-elastic and elastomeric fibers comprise separately melt spun textile denier filaments.

3. Cloth defined in claim 1 wherein each of said elastomeric and non-elastic fibers comprise filaments melt spun through relatively large spinnerette exit orifices and mechanically pulled outwardly thereof to a fine denier.

4. Cloth defined in claim 1 wherein said elastomeric fiber comprises polyurethane.

5. Cloth defined in claim 4 wherein said non-elastic fiber comprises polyester.

6. Cloth defined in claim 1 wherein said non-elastic fiber comprises polyester.

7. Cloth defined in claim 1 wherein said non-elastic fiber comprises polypropylene.

8. Cloth defined in claim 7 wherein said elastomeric fiber comprises polyurethane.

9. Cloth defined in claim 1 comprising a substantially uniform layer having the elastomeric and non-elastic fibers generally uniformly dispersed and mixed therein.

10. Cloth defined in claim 1 wherein said elastomeric and said relatively non-elastic fiber each define a generally distinct laminated layer.

11. Cloth defined in claim 10 comprising a layer of elastomeric fibers disposed generally intermediate a pair of layers of non-elastic fibers.

12. Cloth defined in claim 1 mechanically worked subsequent to bonding, as by stretching in at least one direction followed by relaxation to develop a low modulus of elasticity in at least such one direction.

13. Cloth defined in claim 12 wherein said stretching has been effected generally uni-directionally.

14. Cloth defined in claim 12 wherein said stretching has been conducted generally uniformly in each of a plurality of directions.

15. Cloth defined in claim 1 wherein said bonded fiber crossings are autogenously bonded.

16. Cloth defined in claim 15 wherein substantially all of the fiber crossings are bonded.

17. Cloth defined in claim 15 wherein said bonded fiber crossings comprise a generally uniform pattern of spot bonds.

18. Cloth defined in claim 17 wherein said spot bonds each derive from a knuckle pattern defined from a woven forming fabric embossed therein.

19. Cloth defined in claim 18 wherein said embossed pattern is of a generally square weave fabric.

20. Cloth defined in claim 18 wherein said knuckle pattern is of a generally twill weave fabric.

21. Cloth defined in claim 18 wherein said embossed pattern is of a fabric woven of 12 mil diameter polyester monofilament polyester fibers of substantially equal diameter, which monofilament polyester fabric is characterized by dimensional heat stability, equal knuckle heights and minimum free areas.

22. Cloth defined in claim 1 wherein at least one of said relatively elastomeric and said non-elastic fibers comprise continuous filaments of from approximately ½ to approximately 15 denier randomly looped and bunched into a coherent web and bonded by the application of heat and pressure thereto.

23. Cloth defined in claim 22 wherein each of said fibers comprise continuous filaments of from approximately ½ to approximately 15 denier randomly looped and embossed.

24. Cloth defined in claim 23 wherein one of said filaments is heavier than the other.

25. Cloth defined in claim 1 wherein at least some fibers of each type are bonded at at least two spaced apart locations therealong to fibers of the other type.

26. Cloth defined in claim 25 wherein at least most of the fibers of each type are bonded at at least two spaced apart locations therealong to fibers of the other type.

27. Cloth defined in claim 26 wherein substantially each of the fibers of each type is bonded at at least two spaced apart positions thereof to fibers of the other type.

28. Cloth defined in claim 25 wherein at least some of said bonds are of greater strength than the tensile strength to elongate the non-elastic fibers, enabling elongation of said relatively non-elastic fibers without breaking bonds.

29. Cloth defined in claim 25 wherein said elastomeric filaments comprise approximately 50%, by weight, of the cloth.

30. Cloth defined in claim 25 wherein said elastomeric filaments comprise approximately 20 to 65 percent, by weight, of the cloth.

31. Cloth defined in claim 25 wherein said elastomeric filaments comprise approximately 10–90%, by weight, of the cloth.

32. Cloth defined in claim 25 wherein said cloth is porous and has a basis weight of from about 3–200 grams per square meter.

33. Cloth defined in claim 32 having a basis weight of from about 10–150 grams per square meter.

34. Elastic bonded cloth particularly suitable for lingerie and the like and providing substantially the softness, drape, porosity, hand, feel, elasticity and appearance of a knit rayon jersey comprising, in combination, at least two types of synthetic organic fiber filaments, one of which is elastomeric and the other of which is elongatable but non-elastic, dispersed and random laid to define a substantially unbonded web having well dispersed random fiber crossings, bonded by heat and pressure into a coherent elastic web, stretched in at least one direction subsequent to bonding to permanently elongate at least some of said non-elastic filaments, and relaxed to enable retraction of said relatively elastomeric filaments to provide looping and piling of such elongated non-elastic filaments intermediate the bonds thereof with said elastomeric filaments and development of a modulus of elasticity in said at least one direction substantially that of the elastomeric filaments.

35. Elastic bonded cloth defined in claim 34 wherein said substantially unbonded web is formed on a porous woven forming fabric having generally uniform height rounded knuckles and bonded by passage through a heated bonding nip while carried on such forming fabric to emboss the knuckle pattern into the web and bond the filament crossings at the knuckles together to provide a coherent bonded cloth.

36. Elastic bonded cloth defined in claim 35 wherein said elastomeric filaments comprise approximately one third to two thirds, by weight, of the cloth and said non-elastic filaments approximately the remaining one third to two thirds, by weight, of the cloth, the cloth having a total weight of approximately 30–60 grams per square meter.

37. Elastic bonded cloth defined in claim 36 wherein each of said elastomeric and said relatively non-elastic filaments comprise approximately one-half of the cloth.

38. Elastic bonded cloth defined in claim 35 wherein said elastomeric filaments comprise approximately 10–90%, by weight, of the cloth and the cloth is generally air porous.

39. Elastic bonded cloth defined in claim 36 wherein said non-elastic filaments comprise approximately 3.6 denier melt spun, mechanically drawn polyethylene terephthalate polyester and said elastomeric filaments comprise approximately 5.4 denier melt spun, mechanically drawn polyester based polyurethane.

40. Elastic bonded cloth defined in claim 35 wherein said forming fabric comprises an under two, over one herringbone twill providing a herringbone twill embossed band pattern configuration to the bonded cloth.

41. Elastic cloth-like laminate comprising at least one synthetic organic elastomeric polymer ply and at least one synthetic organic stretchable but non-elastic polymer ply bonded together at a plurality of spaced apart points, the laminate being stretched and relaxed subsequent to bonding to irreversibly stretch the non-elastic polymer ply between the bonded points so that retraction of said elastomeric ply crimps and non-elastic ply between said bond points.

* * * * *

UNITED STATES PATENT OFFICE

CERTIFICATE OF CORRECTION

PATENT NO. : 4,107,364

DATED : August 15, 1978

INVENTOR(S) : James Bryant Sisson

It is certified that error appears in the above-identified patent and that said Letters Patent are hereby corrected as shown below:

Column 2, line 6, "boardly" should read--boardy--.

Column 2, line 12, "herefofore" should read--heretofore--.

Column 14, line 67, "direction" should read--directions--.

Column 15, line 8, "ommidirectional" should read--omnidirectional--.

Column 18, line 17, "filaments" should read--filament--.

Column 33, line 60, "by" should read--be--.

Column 37, lines 17 and 18, delete "relatively".

Column 38, line 6, delete "relatively".

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*